US005256252A

United States Patent [19]

Sarkar et al.

[11] Patent Number: 5,256,252

[45] Date of Patent: Oct. 26, 1993

[54] METHOD FOR CONTROLLING PITCH DEPOSITS USING LIPASE AND CATIONIC POLYMER

[75] Inventors: Jawed M. Sarkar, Naperville; Martha R. Finck, Countryside, both of Ill.

[73] Assignee: Nalco Chemical Company, Naperville, Ill.

[21] Appl. No.: 913,648

[22] Filed: Jul. 15, 1992

[51] Int. Cl.[5] ..... D21C 3/20

[52] U.S. Cl. ..... 162/72; 162/164.6; 162/168.2; 162/DIG. 4; 435/278

[58] Field of Search ..... 162/164.6, 168.2, 181.3, 162/181.8, 199, DIG. 4, 72 B; 435/272, 278

[56] References Cited

U.S. PATENT DOCUMENTS 4,913,775 4/1990 Langley et al. ..... 162/183
4,964,955 10/1990 Lamar et al. ..... 162/DIG. 4

OTHER PUBLICATIONS

Irie, Y. "Enzymatic Pitch Control in Papermaking System", TAPPI Papermakers Conf., Apr. 1990, pp. 1-10.
"Lipase/Esterase-pH-Stat Method on a Tributyrin Substrate," Novo Laboratories, Inc., prior to Aug. 23, 1991, pp. 1-14.
"Applications of Lipase Enzymes in Mechanical Pulp Production," 1991 Pulping Conference, TAPPI Proceedings, K. Gibson, pp. 775-780.
"Resinase TM A 2X," Novo Nordisk A/S, Denmark, Dec. 1990, pp. 1-3.
"On The Use of Resinase TM A for Pitch Control," M. Matsukura, Y. Fujita, H. Sakaguchi, Oct. 1990, pp. 1, 2, 5.
"Enzymatic Pitch Control in Papermaking System," 1990 Papermakers Conference, TAPPI Proceedings, Y. Irie, M. Usui, M. Matsukara, K. Hata, pp. 1-10.
"Understanding the Behavior of Pitch in Pulp and Paper Mills," D. Dreisbach, D. Michalopoulos, Tappi Journal, Jun. 1989, pp. 129-134.
"Reducing Troublesome Pitch in Pulp Mills by Lipolytic Enzymes," Feb. 1992 Tappi Journal, K. Fischer, K. Messner, pp. 130-134.
"Recent Advances in Enzymatic Pitch Control," 1992, Papermakers Conference, Y. Fujita, M. Matsukura, H. Awaji, H. Taneda, K. Hata, N. Shimoto, M. Sharyo, H. Sakaguchi, K. Gibson, pp. 73-79.
Literature Search No. 3818, Sep. 28, 1991, pp. 1-9.

*Primary Examiner*—W. Gary Jones
*Assistant Examiner*—Dean Tan Nguyen
*Attorney, Agent, or Firm*—Joan I. Norek; Robert A. Miller; Joseph B. Barrett

[57] ABSTRACT

A method of controlling pitch deposits in a pulp and papermaking process comprising adding lipase and a cationic polymer to a cellulosic slurry in amounts effective for diminishing pitch deposits from the cellulosic slurry in a pulp and/or paper mill. The method may include adding lipase and a cationic polymer to a cellulosic slurry in amounts effective for both reducing the triglyceride content of a cellulosic slurry by hydrolysis and diminishing the concentration of fatty acids released by the hydrolysis in the aqueous phase of a cellulosic slurry. The triglyceride hydrolysate content of the aqueous phase of a cellulosic slurry, formed by the action of lipase on triglyceride within the cellulosic slurry, is reduced when the amount of lipase and the amount of a cationic polymer is maintained for a time period sufficient to hydrolyze at least some of the triglyceride in the cellulosic slurry and reduce the triglyceride hydrolysate in the aqueous phase of the cellulosic slurry.

20 Claims, 12 Drawing Sheets

FILTRATE TURBIDTY FTU
170
160
150
140
130
120
110
100
90
80
70
60
50
0.0
0.5
1.0
1.5
2.0
ENZYME DOSAGE (in kg/ton dry pulp)
Lipase
Lipase and Cationic Polymer pH
6.4
6.2
6.0
5.8
5.6
5.4
5.2
5.0
4.8
4.6
4.4
4.2
4.0
0 1 2 3 4 5 6 7 8 9 10 11 12 13 14 15 16 17 18 19 20
ALUM (POUNDS/TON DAY PULP)
150 145 140 135 130 125 120 115 110
FILTRATE TURBIDTY FTU
ALUM ALONE
RESINASE & ALUM MIXTURE
FIRST TR. WITH RESI, THEN ALUM.
pH ALUM ALONE
pH RESINASE & ALUM MIXTURE
pH FIRST TR. WITH RESI, THEN ALUM.

METHOD FOR CONTROLLING PITCH DEPOSITS USING LIPASE AND CATIONIC POLYMER

TECHNICAL FIELD OF THE INVENTION

The present invention is in the technical field of controlling pitch deposits for the pulp and papermaking field.

BACKGROUND OF THE INVENTION

The pulp and paper industry produces paper for documents, books, newspapers and the like, and heavier grades for packaging, corrugated paper, shipping containers and the like. The most important source of fiber for these paper products is cellulose, which is derived from wood. Wood is generally classified as either softwood, which provides long-fibered pulps, and hardwood, which provides short-fibered pulp. Pulping operations generally fall within one of three broad categories, namely, operations producing mechanical pulp (groundwood and thermomechanical pulps), chemical pulp (sulphate, sulphite, soda, Kraft and semi-chemical pulps) and secondary fiber pulp (reclaimed paper pulp). Most, but not all, of the wood intake of the soda, Kraft and semi-chemical pulping processes is hardwood. Most, but not all, of the wood intake for the mechanical, sulphate and sulphite pulping processes, is softwood. Pulp is bleached or not generally depending on its intended end-use. In general, mechanical pulps are seldom bleached, while chemical pulps are often, but not always, bleached. The pulp used for most types of products are blends of pulps from different pulping processes, and such blends may include both bleached and unbleached pulps. For instance, carton board may be formed from mainly unbleached mechanical pulp, with minor proportions of bleached soda pulp and bleached semi-chemical pulps, while soft tissue paper may be formed from mainly bleached sulphite and sulphate pulps, with minor portions of bleached soda pulp and unbleached semi-chemical pulp.

About half of the weight of timber is cellulose. Without the bark, depending on the species, the trunk of a tree consists of from about 65 to about 85 percent fiber, bound together with from about 15 to about 35 percent lignin. The pulping process separates the fibers preparatory to their reintegration in the final product. Logs are first debarked, by which about 7 to 9 percent of their weight is removed. The cleaned logs are then pulped either mechanically or, after being cut into chips, chemically.

In the production of the mechanical pulp known as groundwood pulp, debarked logs are generally loaded into the magazine of a grinder in which they are pressed against a grinding wheel to separate the bundles of fibers into individuals strands. Except for a small percentage of organic matter extracted during the grinding process, the lignin, a noncarbohydrate portion of wood that held the fibers together, remains in the finished pulp. The paper produced by mechanical pulping is used for the manufacture of impermanent papers, such as newsprint, catalogs, magazines, paperboard and the like, often as a blend with some chemical pulp to increase the paper strength to the degree required for the given printing press and end use.

Another process for producing mechanical pulp is thermomechanical pulping wherein wood chips are washed with recycled water, then macerated in a screw press to a homogeneous slush, and passed continuously through a steam-heated digester. The recycled water may be white water or filtrate that contains pulp chemical residues. This treatment softens the fibers and permits them to separate somewhat from lignin, which improves refining and produces a mechanical pulp superior to groundwood pulp in strength. Refining is conducted in three stages following the digester. The refined pulp is screened, cleaned, and then may be adjusted to the required consistency for bleaching. (Hydrosulfite and hydrogen peroxide are the bleaching chemicals used for both groundwood and thermomechanical pulps.)

Chemical pulping employs chemicals to soften or dissolve the lignin and other organic materials holding the fibers together, so as to release the fibers without extensive mechanical working. This softening or dissolving process is known as digestion. The basic chemical processes are classified as acid, neutral or alkaline pulp processes. The acid pulping processes include those designated acid sulfite, sodium base, ammonium base, calcium base and magnesium base. The neutral processes include those designated neutral sulfite, neutral sulfite-semichemical, and chemiground. The alkaline processes include those designated Kraft and Kraft-semichemical. The Kraft process, which uses a mixture of sodium hydroxide and sodium sulfite, is also known as "sulfate" process. The soda process, used in very few mills, uses sodium hydroxide alone as the alkaline agent. In the chemiground and Kraft-semichemical processes, liquor is used to soften the wood before grinding. In all of the chemical pulping processes, a chemical solution is fed to a digester, in which it is mixed with wood that has been cut into chips to permit the liquor to penetrate effectively and produce a uniform pulp. The mixture is then cooked for a specified period at the optimum temperature for the particular process and the type of wood being pulped. Most digesters operate on a batch basis, but continuous digestion processes are increasingly coming into use.

Untreated wood generally contains some amount of pitch, which is typically located in parenchyma cells and on the surfaces of the fiber. Based on solubility in ethyl ether values, pitch may comprise from about 0.7 to about 2.4 weight percent of hardwoods such as beech and white birch, and from about 0.7 to about 4.3 weight percent of softwoods such as eastern hemlock and jack pine, based on the total weight of unextracted (oven-dry) wood.

The term "pitch" refers to a variety of naturally occurring, hydrophobic, organic resins of low and medium molecular weight, and to the deposits these resins cause during the pulping and papermaking processes. Pitch includes fatty acids, resin acids, their insoluble salts, and esters of fatty acids with glycerol (such as the triglycerides) and sterols, as well as other fats and waxes. These compounds display characteristic degrees of temperature-dependent viscosity, tackiness, and cohesive strength. They may deposit alone or together with insoluble inorganic salts, filler, fiber, defoamer components, coating binders, and the like.

Pitch deposits may occur throughout a pulp or paper mill and these deposits can both degrade product quality and impair production rates. They can impair production rates by decreasing the efficiency of pulp washing, screening, centrifugal cleaning, and refining, and disrupting many paper machine operations. Pitch can degrade the product paper by causing spots, holes, picking, and scabs in the final paper product or sheet.

Present paper production trends are likely to increase pitch deposit problems, unless such problems are counteracted by more effective control methods. Such present production trends include the use of: high-speed machines that create high shear rates and greater pitch deposits; higher production rates that increase the load on washing equipment and thus increase the concentration of pitch in the stock; defoamer chemicals which may aggravate pitch deposition problems; high-yield chemical and mechanical pulps that often contain more resinous pitch materials; and the reuse of white water, and more complete closure, which concentrate pitch and aggravate pitch deposition, particularly in bleach plants. These trends all increase the potential for pitch deposition problems, and the severity of such problems when they occur. High-quality paper products, however, must be virtually free from pitch-related defects.

Past efforts to control pitch problems are widely varied. Common pitch control measures include aging or seasoning wood, the use of wood species with low resin contents, and the modification of pulping parameters. Modifications in pulping parameters include process variables such as pH, temperature, first-pass retention, washing efficiency, bleaching agent and the like. Modifications in pulping parameters also includes the use of process additives, such as dispersants, cationic polymers, alum, and talc, all of which have been employed to control pitch problems.

The composition of the pitch is a major factor in the amount of pitch that deposits and the characteristics of the deposits. Pitch composition varies depending on the season and the type of wood and thus some pitch problems appear only in certain months of the winter and spring, and some wood species create greater pitch problems during pulping and papermaking than other species. The nonpolar, hydrophobic components of pitch, particularly the triglycerides, in a given pitch composition are considered the major factors as to whether or not the presence of such pitch will lead to pitch deposits. Deposit-forming pitch always contains a significantly higher concentration of triglyercides than pitch that forms no deposits. As further verification of this relationship, it has been determined that triglycerides decompose during seasoning (storage of cut wood before use), and seasoning, as noted above, is a known technique for reducing pitch deposits. Seasoning requires storage of logs for long periods, and thus creates time delays between the harvesting of the logs and their use, and requires a substantial amount of storage space. Moreover, seasoning often leads to decreased pulp brightness. Therefore decomposition of the triglyceride components of pitch by seasoning is often impossible or impractical. A pitch control method that alleviates the need to season wood is considered extremely desirable in the pulp and papermaking field.

It is an object of the present invention to provide a pitch control method that selectively acts upon the triglyceride components of the pitch. It is an object of the present invention to provide a pitch control method that removes not only triglycerides, but also the hydrolysates of triglycerides, from the aqueous phase of a cellulosic slurry. It is an object of the present invention to decompose the triglycerides of pitch without the long storage time, and extensive storage space, required by the seasoning method. It is an object of the present invention to provide such a pitch control method that may be used both for mechanical and chemical pulps. It is an object of the present invention to provide pitch control without introducing undesirable treatment chemicals into the aqueous system of the pulp and papermaking process. These and other objects of the invention are described in more detail below.

DISCLOSURE OF THE INVENTION

Figure 1:
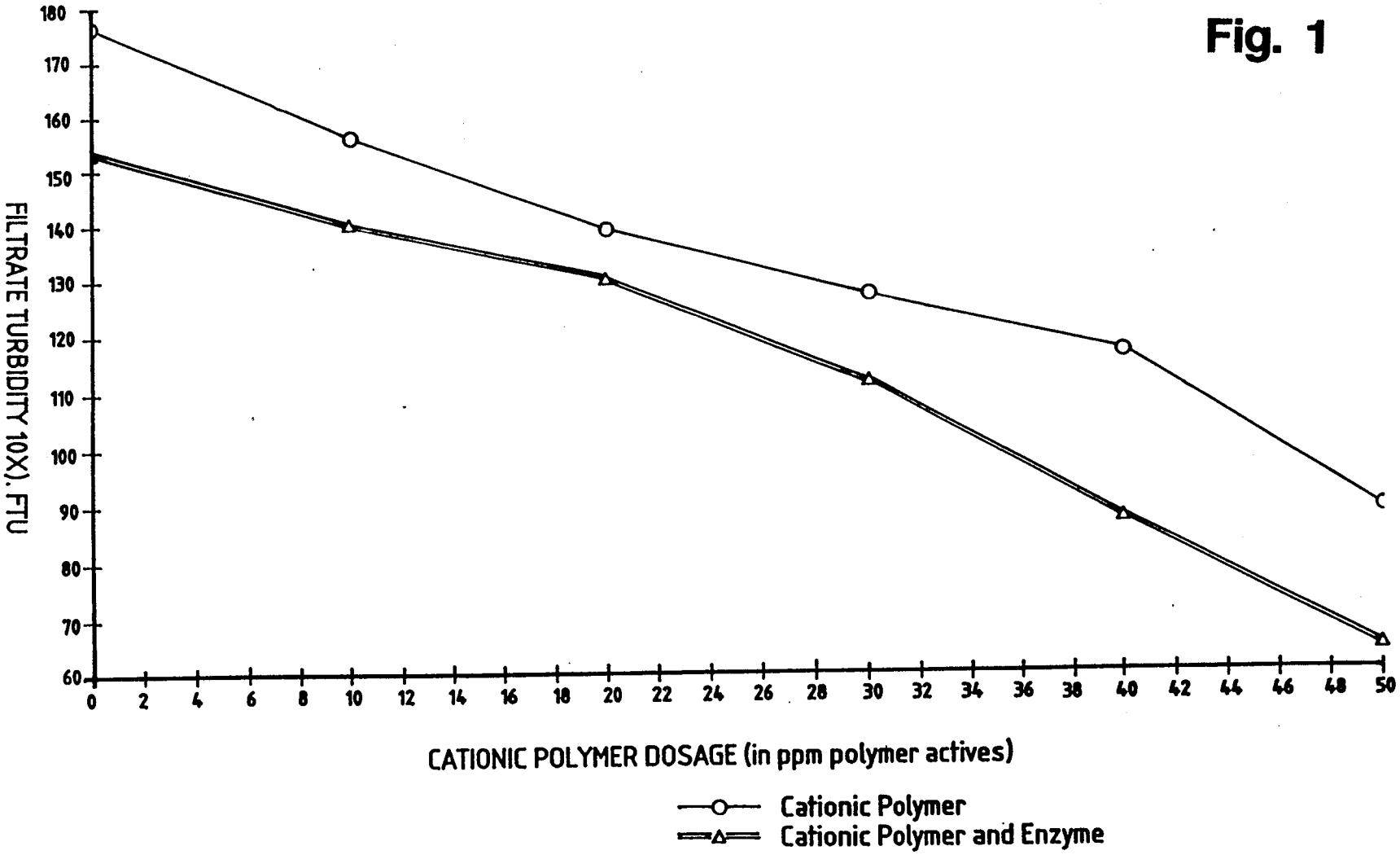
FIG. 1 is a plot of the pitch control performance, versus cationic polymer dosage, of a pitch control treatment of the present invention and a cationic polymer only treatment for comparison.

The present invention provides a method of controlling pitch deposits in the pulp and papermaking process comprising adding lipase and a cationic polymer to a cellulosic slurry in amounts effective for diminishing pitch deposits in the pulp and/or paper mill. A cellulosic slurry is an aqueous mixture containing water-insoluble cellulosic material. In more detail, the method of the present invention comprises aforesaid addition of lipase and a cationic polymer under agitation conditions sufficient to substantially disperse the lipase and cationic polymer in the slurry. In preferred embodiments, the treated cellulosic slurry is subjected to elevated temperatures conditions to provide an incubation period during which the activity of the lipase and cationic polymer proceeds. These and other preferred embodiments are described in more detail below.

PREFERRED EMBODIMENTS OF THE INVENTION

Triglycerides are naturally occurring esters of a carboxylic acid, normally a fatty acid, and glycerol (1-,2-,3-propanetriol). Triglycerides are the chief constituents of fats and oils. They have the general formula of $CH_2(OOR_1)CH(OOCR_2)CH_2(OOR_3)$ wherein $R_1$, $R_2$ and $R_3$ are hydrocarbon radicals that may differ as to chain length, degree and site of carbon to carbon unsaturation and the like. Such hydrocarbon radicals are the carboxylic acid portions of the triglyceride ester, and such acids are, as noted above, fatty acids. Triglycerides are hydrophobic organic resins.

Hydrolysis converts triglycerides to its hydrolysates, that is, glycerol and carboxylic acids. Glycerol itself is a polar, trihydric alcohol that is soluble in water, and insoluble in ether, benzene, chloroform and various oils. Release of glycerol to the aqueous phase of a cellulosic slurry by virtue of the hydrolysis of pitch triglycerides is not considered detrimental to either the production rates or product quality. The release of the fatty acids of the triglycerides, however, may well be undesirable, and thus mere hydrolysis of the triglycerides, alone, is not an optimum pitch control method.

Fatty acids, in broad definition, are composed of a straight-chain of alkyl groups, contain from 4 to 22 total carbon atoms (usually even numbered), and are characterized by their terminal carboxylic acid radical —COOH. Fatty acids may be saturated or unsaturated (olefinic), and either solids, semisolid or liquid. They are considered lipids. The unsaturated fatty acids usually are vegetable-derived and commonly contain a total of from about 18 to 22 carbon atoms. The most common unsaturated acids are oleic, linoleic and linolenic, all of which contain a total of 18 carbon atoms, differing one from another by their unsaturation characteristics. The most common saturated fatty acids are palmitic and stearic acids, saturated acids having respectively 16 and 18 total carbon atoms.

Linolenic acid (9,12,15-octadecatrienoic acid) is a polyunsatured fatty acid (3 double bonds) that is a colorless liquid at temperatures encountered during pulping and papermaking processes (melting point of −11° C. and boiling point of 230° C. at 17 mm), insoluble in water, and is the fatty acid component of the linolenin glyceride (trilinolenin as the triglyceride). Linoleic acid is a polyunsaturated fatty acid (2 double bonds) that is a colorless to straw-colored liquid at temperatures encountered during pulping and papermaking processes (melting point of −5° C. and boiling point of 228° C. at 14 mm), insoluble in water, and is the fatty acid component of the linolein glyceride (trilinolein as the triglyceride). Oleic acid (cis-9-octadecenoic acid) is a monounsaturated fatty acid (1 double bond) that is a yellow to red (water-white when purified) liquid at temperatures encountered during pulping and papermaking processes (melting point of 13.2° C. and boiling point of 286° C. at 100 mm), insoluble in water, and is the fatty acid component of the olein glyceride (triolein as the triglyceride). Palmitic acid (hexadecanoic acid) is a water insoluble crystal at temperatures below about 63° C. (melting point of 62.9° C.) and is the fatty acid of the tripalmitin triglyceride. Stearic acid (n-octadecanoic acid) is a water insoluble wax-like solid below about 70° C. (melting point of 69.6° C.), and is the fatty acid component of the stearin (or tristearin) triglyceride. All of these fatty acids, and all of the triglycerides thereof, except stearin, are soluble in ethyl ether.

All of the fatty acids, as alkali, alkaline earth metal, or like salts, are considered soaps or surface-active agents and/or emulsifying agents. Fatty acids having alkyl chain lengths greater than valeric acid are, in acid form, only slightly soluble in water, or are water insoluble. In "water soluble" salt form, however, these anionic compounds are at least dispersible in water, lower the surface tension of water, concentrate at a water-oil interface and promote the emulsification of hydrophobic material.

The triglycerides most common in softwood pulps contain mainly unsaturated C-17 and saturated C-15 fatty acids. The triglycerides most common in hardwood pulps contain both unsaturated C-16 and C-18 fatty acids. These fatty acids, regardless of whether in acid or in water-soluble salt form, are not desirable free components of a cellulosic slurry. As water-insoluble solids or liquids, they themselves can form deposits on the equipment or on the final product. In their water-soluble salt forms they can promote emulsions that are undesirable because of their tendency to precipitate in hard water.

The present invention both reduces the triglyceride content of a cellulosic slurry and diminishes the concentration of fatty acids in the aqueous phase of a cellulosic slurry, whereby an enhanced control of pitch deposits is achieved.

The enzyme component is a lipase. Enzymes are protein catalysts, and they are generally specific not only as to the type of reaction catalyzed but also the substrate on which the enzyme acts. Lipase is a class of hydrolytic enzymes that act upon the ester bond of neutral lipids and phospholipids. Lipases specifically hydrolyze triglycerides, or fats, to glycerol and fatty acids. Unlike acids or bases or other catalysts for ester hydrolysis, the inclusion of a lipase in a cellulosic slurry will not lead to the undesirable catalysis of other reactions.

The activity of an enzyme generally varies with the pH of its environment, the pH affecting the affinity of the enzyme for its substrate or the stability of the enzyme. A pancreas lipase has an optimum pH of about 8.0. A stomach lipase has an optimum pH within the range of from about 4 to about 5.

Enzymic reactions are also affected by the temperature of the environment. A temperature elevation in many instances is initially seen to increase the initial reaction velocity of the reaction being catalyzed, but if the temperature is too high, enzymic activity will decrease with time due to enzyme denaturing.

Lipase can be extracted from milk, wheat germ and various fungi, and other animal or vegetable tissue, but like most enzymes, it is more economically produced by fermentation of selected microorganisms.

Resinase A 2X is the tradename of a commercially available lipase available from Novo Nordisk Bioindustrials, Inc., of Danbury, Conn. Resinasem A 2X is produced by monoculture fermentation of a nonpathogenic and nontoxigenic strain of *Asperigillus oryza*. Resinase A 2X is more fully described in a "Product Sheet" entitled "RESINASE TM A 2X", copyright December 1990, Novo Nordisk A/S, available from Novo Nordisk, and incorporated hereinto by reference.

The present invention is believed most useful for mechanical pulps or thermo-mechanical pulps because the conditions of these pulping processes are too mild to produce any significant degradation of triglycerides or other pitch components. In contrast, the Kraft pulping process employs alkaline conditions at elevated temperatures, which conditions themselves hydrolyze triglycerides, and the fatty acids released thereby are removed, in soap form, with other impurities during the washing stage of the pulping process. Thus the pulp produced by the Kraft process, or other pulping process employing alkaline conditions at elevated temperatures, typically requires no pitch control treatment. Nonetheless the use of the present treatment on such a pulp is not excluded by the present invention, should such a pulp present a pitch control problem. Acidic conditions also catalyze ester hydrolysis, but acid hydrolysis is a reversible reaction, and under acidic conditions the fatty acids released would generally not be converted to soaps, and hence would not routinely be removed from the pulp during the washing step. The treatment of the present invention is thus also believed to be useful for pulps produced by chemical pulping processes of the acid or neutral type.

The utility of the treatment process of the present invention is not believed dependent upon whether the pulp is derived from softwood, hardwood or blends thereof.

In preferred embodiment, the cellulosic slurry to be treated is at an elevated temperature at the time the enzyme and cationic polymer are added thereto, and held at such elevated temperature for an incubation period. In more preferred embodiment, the temperature of the cellulosic slurry is from about 35° C. to about 55° C. at the time of the addition of the enzyme and cationic polymer, and held within this temperature range for a time period of from about 1.5 to about 4 hours after the treatment components have been charged. The elevated temperature condition increases the rate of the enzymic catalysis, but it is believed that enzymic activity will occur at much lower slurry temperatures. For instance, temperatures as low as about 25° C. or 20° C., or even lower, may also be suitable for the enzymic activity of the lipase. Such lower temperatures are expected to require longer "incubation" periods without any concomitant process benefit, unless of course an elevated temperature environment is not already available in the production process, and cannot be readily provided. Temperatures higher than 55° C. may also be possible if such temperature does not unduly denature (inactivate) the lipase being used. In broad terms, the temperature of incubation should be sufficiently high to provide some degree, and preferably a reasonable rate, of enzymic reaction, and the incubation temperature should be below that which wholly inactivates the lipase, and preferably below that which so inactivates the lipase that the rate of triglyceride hydrolysis falls below the rate desired. Thus the incubation temperature should be within a range effective for lipase enzymic activity. The incubation time period should be sufficient for lipase activity, given the incubation temperature. There is no practical reason for extending the incubation period beyond that required, at a given incubation temperature, to reduce the triglyceride content of the slurry and the fatty acid concentration of its water phase, as required, for pitch control. The economics of production normally argue against prolonging incubation beyond the time required for pitch control. It is nonetheless possible that a given production set up may include a stage for other purposes, or even a holding area, that can be used for incubation, and then the time/temperature conditions already in use at that stage would be considered preferred for that facility. A very effective combination of incubation temperature and time period has been found to be 45° C. for a period of about 2 hours, and this combination is considered a very preferred embodiment of the present invention.

In preferred embodiment the temperature of the cellulosic slurry is raised to the desired incubation temperature before the enzyme and cationic polymer are charged thereto. In such preferred embodiment there is no delay in the realization of the enzymic activity seen at incubation period. Such preferred embodiment is also desirable because its treatment conditions are compatible with settings routinely used in existing mills. Nonetheless the present invention does not exclude the possibility of first charging the enzyme and cationic polymer to the cellulosic slurry and then heating the slurry to the desired incubation temperature. The present invention also does not exclude the possibility of charging the enzyme and cationic polymer to the slurry when the slurry is hotter than the desired incubation temperature, and then lowering such temperature, provided of course that the initial slurry temperature, or any intervening slurry temperature prior to the desired degree of triglyceride hydrolysis, is not so high that the enzyme is inactivated. The present invention also does not exclude variations in slurry temperature during incubation, provided of course that temperatures which inactivate the enzyme are avoided, at least during the initial stages of the incubation.

In general, the pH of the slurry during incubation, or at least during a sufficient portion of the incubation time to effectuate the desired degree of triglyceride hydrolysis, is within the range in which the given lipase being used is active. In preferred embodiment, the pH of the slurry during incubation, or at least during a sufficient portion of the incubation time to effectuate the desired degree of triglyceride hydrolysis, is within the range of from about 4 to about 8.0, and more preferably from about 4.0 to about 7. The commercial lipase used in the Examples hereof has been found to be very active within a range of from a pH of about 4.5 to a pH of about 6.5. The pH of choice, however, to some extent is dependent upon the specific lipase employed, and the optimum pH differs somewhat for different lipases. Nonetheless the slurry pH during the incubation step preferably should be effective for both enzymic activity and for cationic polymer activity in reducing the concentration of fatty acids in the aqueous phase of the slurry. The present invention does not exclude the possibility of varying the pH during the incubation period, but it is preferable not to vary the pH. When the slurry pH is varied during the incubation period, it is preferable if the initial pH is selected for optimal enzymic activity and the later pH is selected for optimal cationic polymer activity. At minimum, the initial pH should be within a range that provides some enzymatic activity, and the later pH, if the pH is varied, should not exceed about 10.

The cellulosic slurry should preferably be under agitation during the incubation period. The degree of agitation should again be within a range effective for diminishing the triglyceride content of the cellulosic slurry and decreasing the concentration of fatty acids in the aqueous phase thereof. The agitation promotes the distribution of the treatment components in the slurry and of course is dependent in part on the rheological parameters. In general, the cellulosic slurry should have a consistency of from about 0.1, or 0.5, to about 8, or possibly even 10, and more preferably a consistency of not less than about 1.0 or 1.5. Higher pitch control levels are seen at the higher pulp consistencies, which is discussed elsewhere herein. High shear probably should be avoided during the treatment period, although high shear after treatment does not have a deleterious effect, as is discussed elsewhere herein. For most pulp slurries, agitation of the degree equivalent to an efficient circular motion stirring, at a rate of from about 100 to about 500 rpm, and preferably from about 200 to about 300 rpm, should provide sufficient circulation and dispersion of the slurry components during incubation.

The specific action of a lipase on triglycerides, hydrolyzing them to glycerol and fatty acids, is a well established fact. The action of the cationic polymer in combination with lipase has been found to result in a decreased concentration of fatty acids in the aqueous phase of the cellulosic slurry. The combination of lipase and cationic polymer has been found to decrease the turbidity of the slurries aqueous phase. Turbidity has been shown to be a measure of presence of pitch components leading to pitch deposit problems. The combination of lipase and cationic polymer provides a greater reduction in turbidity than is possible with either component alone. Moreover, as noted above, in combination with the lipase the cationic polymer diminishes the fatty acid concentration in the slurries aqueous phase, while without the enzymic activity there is little to no fatty acid in the slurry. Hence the activity of the cationic polymer in combination with the enzyme necessarily differs from its specific turbidity-reducing activity when used alone, at least as to the species on which it is acting.

In preferred embodiment the cellulosic slurry to which the enzyme and cationic polymer are added for pitch control treatment is cellulosic slurry product of a pulping process, preferably before any further processing steps, such as before the bleach plant.

In preferred embodiment the lipase is charged to the cellulosic slurry separate from, and before, the dosage of cationic polymer. The present invention does not, however, exclude charging the enzyme and cationic polymer at about the same time, or even together, because the cationic polymer has no inhibitory effect on lipase activity. They may therefore be charged to the celllosic slurry in the same intake water stream. The present invention also does not exclude adding the cationic polymer to the cellulosic slurry prior to the addition of the lipase.

In preferred embodiment the cationic polymer is charged to the cellulosic slurry as a dilute aqueous solution of polymer actives, for instance as an aqueous solution containing from about 0.05 to about 0.5 weight percent of cationic polymer actives. The addition of the polymer as a dilute solution facilitates a rapid dispersion of the polymer through the slurry. For most cationic polymers, there is little to no benefit to using a solution containing less than a 0.05 weight percent polymer, although there generally is no practical reason for avoiding such dilutions other than possibly handling factors. The cationic polymer is employed at very low dosages, and thus slurry dilution is not a significant factor even when very dilute solutions of the polymer are employed. The preferred high concentration of the polymer solution, that is 5.0 weight percent, is also not a maximum or ceiling level if for a given cationic polymer solutions of higher concentrations are still of reasonable viscosity. The choice of polymer concentration for a given polymer, for charging to a given slurry, to provide a reasonably rapid and thorough dispersion of the polymer in the slurry is a parameter that can be easily selected by one of ordinary skill in the art.

In preferred embodiment the lipase, like the cationic polymer, is charged to the cellulosic slurry as a dilute aqueous solution, for instance as an aqueous solution containing from about 0.02, or 0.04, to about 0.2 weight percent of a 100 KLU/gram lipase product, such as RESINASE A 2X. One KLU (Kilo Lipase Unit) is the amount of enzyme which liberates one millimole butyric acid per minute from a tributyrin substrate in a pH-stat under the following standard conditions: substrate of tributyrin; temperature of 30° C.; and pH of 7.0. The addition of the enzyme as a dilute solution also facilitates its rapid dispersion through the slurry. There is little to no benefit to using a solution containing less than a 0.01 weight percent of RESINASE A 2X or another lipase preparation of similar activity. The preferred high concentration of the lipase solution, that is 0.2 weight percent of a 100 KLU/gram lipase preparation, is not a maximum or ceiling level if, for a given lipase preparation, solutions of higher concentrations are still of reasonable viscosity. The choice of lipase concentration, for charging to a given slurry, to provide a reasonably rapid and thorough dispersion of the enzyme in the slurry is a parameter that can be easily selected by one of ordinary skill in the art.

In preferred embodiment, the dosage of the lipase is from about 110 to about 2,200 ppm (parts per million), based on the weight of a 100 KLU/gram lipase preparation in comparison to the dry weight of slurry solids. In more preferred embodiment, the dosage of the lipase is from about 200 to about 1,000 ppm, based on the weight of a 100 KLU/gram lipase preparation in comparison to the dry weight of slurry solids. In even more preferred embodiment, the dosage of the lipase is from about 275 to about 550 ppm, based on the weight of a 100 KLU/gram lipase preparation in comparison to the dry weight of slurry solids.

By a lipase dosage, in terms of a lipase preparation having an activity of 100 KLU/gram, that is for instance, a dosage of a 100 KLU/gram lipase preparation, is meant herein not only such specific dosage using a lipase preparation having that activity level, but also a comparable dosage of a lipase preparation having a different activity level.

In preferred embodiment, the dosage of the cationic polymer is from about 1 to about 150 ppm, based on the weight of cationic actives in comparison to the dry weight of slurry solids. In more preferred embodiment, the dosage of the cationic polymer is from about 10, or 20, to about 80, or 100, ppm based on the weight of cationic polymer actives in comparison to the dry weight of slurry solids. In even more preferred embodiment, the dosage of the cationic polymer is from about 20, or 30, to about 60, or 70, ppm based on the weight of cationic polymer actives in comparison to the dry weight of slurry solids.

If an aqueous solution of buffer is to be charged also for pH adjustment, the cationic polymer may be added in the same solution, or these can be added separately.

The cationic polymer component of the pitch control treatment comprises a water-soluble quaternary amine-based cationic polymer. By "water-soluble" is meant that the cationic polymers are soluble or dispersible in the cellulosic slurry at an effective use concentration. The cationic polymer preferably has a molecular weight sufficiently high so that it has chain length of a traditional polymer, rather than an oligomer, but on the other hand, the molecular weight should not be so high that the cationic polymer is not water dispersible at least. The weight average molecular weight of the cationic polymer is from about 5,000 to about 5,000,000 daltons, preferably from about 10,000 to about 3,000,000, and more preferably from about 20,000 to about 3,000,000 daltons. Representative cationic polymers include, for example:

1. the quaternized salts of polymers of N-alkylsubstituted aminoalkyl esters of (meth)acrylic acid including, for example, poly(diethylaminoethylacrylate) acetate, poly(diethylaminoethyl-methyl acrylate), poly(-dimethylaminoethylmethacrylate) ("DMAEM.MCQ" as the methyl chloride quaternary salt) and the like;

2. the quaternized salts of reaction products of a polyamine and an acrylate type compound prepared, for example, from methyl acrylate and ethylenediamine;

3. polymers of (methacryloyloxyethyl)trimethyl ammonium chloride;

4. copolymers of acrylamide and quaternary ammonium compounds such as acrylamide and diallylmethyl(beta-propionamido)ammonium chloride, acrylamide(beta-methacryloyloxyethyl)trimethylammonium methyl sulfate, and the like;

5. quaternized vinyllactam-acrylamide copolymers;

6. the quaternized salt of hydroxy-containing polyesters of unsaturated carboxylic acids such as poly-2-hydroxy-3-(methacryloxy)propyltrimethylammonium chloride;

7. the quaternary ammonium salt of polyimide-amines prepared as the reaction product of styrene-maleic anhydride copolymer and 3-dimethylaminopropylamine;

8. quaternized polyamines;

9. the quaternized reaction products of amines and polyesters;

10. the quaternized salt of condensation polymers of polyethyleneamines with dichloroethane;

11. the quaternized condensation products of polyalkylene-polyamines and epoxy halides;

12. the quaternized condensation products of alkylene-polyamines and polyfunctional halohydrins, such as epichlorohydrin/dimethyl amine polymers ("EPI-DMA");

13. the quaternized condensation products of alkylene-polyamines and halohydrins;

14. the quaternized condensation polymers of ammonia and halohydrins;

15. the quaternized salt of polyvinylbenzyltrialkylamines such as, for example, polyvinylbenzyltrimethylammonium chloride;

16. quaternized salt of polymers of vinyl-heterocyclic monomers having a ring nitrogen, such as poly(1,2-dimethyl-5-vinylpyridinium methyl sulfate), poly(2-vinyl-2-imidazolinium chloride) and the like;

17. polydialkyldiallylammonium salt including polydiallyldimethyl ammonium chloride ("polyDADMAC");

18. polymers of vinyl unsaturated acids, esters and amides thereof and diallyldialkylammonium salts including poly(acrylic acid-diallyldimethylammonium chloride-hydroxypropylacrylate) ("polyAA-DADMAC-HPA");

19. polymethacrylamidopropyltrimethylammonium chloride ("polyMAPTAC");

20. the quaternary ammonium salt of ammonia-ethylene dichloride condensation polymers; and 21. the quaternized salt of epoxy halide polymers, such as the polyepichlorohydrin methyl chloride, polyepichlorohydrin methyl sulfate and the like.

Preferred cationic polymers include polyDADMAC, acrylic acid/DADMAC copolymers, DMAEM.MCQ/acrylamide copolymers, EPI-DMA polymers and the like, with DADMAC homopolymer and acrylic acid/DADMAC copolymers being particularly preferred. The aforementioned cationic polymers as used in the additive of the present invention are well known in the art and are commercially available. The higher molecular weight cationic polymers are often conveniently commercially supplied as water-in-oil latex form, which upon emulsion inversion by well known techniques releases the cationic polymer of the water phase. Such water-in-oil emulsions facilitate the rapid dispersion and/or dilution of such high molecular weight cationic polymers.

As can be noted from the above list of specific cationic polymers, the polymer may be one that is considered amphoteric, for instance DADMAC/acrylic acid copolymers, provided that the cationic nature of the polymer is retained in the sense that the cationic mer units of the polymer predominate over the anionic mer units thereof. Preferably the mole ratio of cationic mer units to anionic mer units is at least about 2:1 when the polymer is amphoteric. The anionic mer units may be derived from such monomers as acrylic acid, maleic acid, itaconic acid, crotonic acid, methacrylic acid, and the like monomers having pendant carboxylic acid radicals, or monomers that under preparation, storage or use conditions provide such pendant carboxylic acid radicals such as alkyl esters, anhydrides or amides of the above anionic monomers. The anionic radicals may be other than the carboxylic acid types, and instead by a sulfonate-type, such as derivatized acrylamides having alkyl sulfonate N-substituents, and the like.

The cationic polymer may contain polar mer units, such as (meth)acrylamide, acrylonitrile and the like, or less polar nonionic mer units, such as the lower alkyl esters of (meth)acrylic acid, for instance the $C_{1-4}$ alkyl esters of (meth)acrylic acid, provided such hydrophobic nature and density of such less polar mer units do not overly diminish the water solubility of the cationic polymer at use concentration.

The cationic charge density of the cationic polymer preferably should be relatively high, although a lower charge density has been found effective for the purposes of the present invention when the polymer is of a relatively high molecular weight. In general, the cationic polymer preferably has a cationic charge density of from about 1 meq/gram to about 8 meq/gram, and more preferably from about 2 meq/gram to about 8 meq/gram. In another preferred embodiment, the cationic polymer is of a relatively low molecular weight of from about 5,000 to about 1,000,000 daltons, and a relatively high charge density of from about 6.0 meq/gram to about 8.0 meq/gram. In another preferred embodiment, the cationic polymer is of a relatively high molecular weight of from about 500,000 to about 3,000,000, and a relatively low cationic charge density of from about 1, or 2, meq/gram to about 5.5, or 6, meq/gram.

TEST METHOD

The pitch control performance of various embodiments of the present invention was determined using the following laboratory test method. The sample treatment portion of the test method simulates a commercial pitch control treatment. When any part of this test method was modified, the modification is described in the specific Example. The pulps employed for this test method were most often, but not always, alum-free aqueous slurries of a stone groundwood Aspen pulp from commercial paper mills. Such slurries, as used, generally had about a 5 percent consistency and a pH value of about 7.0. Specific details concerning the pulps employed for specific Examples are described below. For an Example and its respective Comparative Example, a series of twelve samples of a given pulp slurry, each containing 50 grams of the pulp slurry, were tested. Five of these samples are treated with only polymer (the Comparative Examples), five are treated with a combination of polymer and enzyme (the Examples), and the remaining two serve as blanks for the Example (enzyme treatment only) and the Comparative Example (no treatment). The polymer is tested at dosages of 0, 10, 20, 30, 40 and 50 ppm polymer actives based on dry pulp solids, for both the Example and Comparative Example, the 0 ppm of polymer tests being of course blanks. The enzyme dosage used is 0.5 kilogram of enzyme solution (a 100 KLU/gram solution) per ton of dry pulp solid ("kg/ton"). (0.5 kg/ton is equivalent to 550 ppm.) The slurry samples are first placed in erlenmeyer flasks and heated to 45° C. in a constant temperature (45° C.) incubator (held therein for a time period of 0.5 hours) before any treatment is added. Then the treatments are charged to the samples, the enzyme first, and then the cationic polymer, plus about 5 ml. of pH 6, 0.05M sodium citrate phosphate buffer and additional distilled water where necessary to maintain equal volumes. After treatment addition, the samples are shaken in a circular motion at a speed of 250 rpm for a 2-hour incubation period, during which time period the samples are held in the 45° C. incubator. The treatments are charged as aqueous solutions, and thus the greater dilution that occurs with the highest treatment dosage is balanced by the addition of dilution water to the other samples in a given series, as noted above. Therefore all of the samples in an Example and Comparative Example series of tests, including the blanks, are of the same volume. The polymer is added as a 1 weight percent aqueous solution based on polymer actives. The enzyme is generally added as a 10 weight percent aqueous solution based on enzyme "product" or "solution" (a 100 KLU/gram product or solution). The samples, after the incubation period, are filtered through Reeves brand 202 filter papers (manual pressure) until pulp solids were dry (determined by touch and collecting equal amounts of filtrate). The filtrate for each test is then agitated to completely disperse any settled materials, and the turbidity of a 2.5 ml. sample thereof, diluted to 25 ml. with distilled water, is determined on a Hach DR 2000 portable spectrophotometer at 450 nm using the #750 turbidity program. The lower the filtrate turbidity, the greater is the pitch control of the treatment employed, as discussed in more detail elsewhere herein.

The enzyme employed in Examples below was the commercially available lipase enzyme sold under the tradename of Resinase A 2X by Nordisk Bioindustrials, Inc., of Danbury, Conn., which is described in more detail above.

The characteristics of the various pulp slurries used in the Examples, together with pulp slurry designations used in the Examples and an identification of the Example numbers in which each given slurry is used, are set forth below in Table A.

TABLE A

| Pulp Slurries | | | | |
|---|---|---|---|---|
| Slurry Designation | Type | Consistency | pH | Example/Comparative Example |
| GW-1 | Groundwood Aspen pulp | 5.0% | 6 | 1/1', 2/2', 5/5', 7/7', 14 |
| GW-2 | Groundwood Aspen pulp | 4.2% | 6 | 3/3', /11', 12, 13 |
| GW-3 | Groundwood Aspen pulp | | | 8/8', 9/9', 10/10' |
| S-1 | Unbleached Sulfite pulp | 3.4% | 3* | 4/4' |

*The slurry pH was adjusted before test use as described in the relevant Example(s).

The characteristics of the various cationic polymers used in the Examples, together with polymer designations used in the Examples and an identification of the Example numbers in which each given polymer is used, are set forth below in Table B.

TABLE B

| Cationic Polymers | | | | |
|---|---|---|---|---|
| Polymer Designation | Mer Units | Mer Unit Mole Ratio | MWt | Examples/ Comparative Examples |
| A | DADMAC | 100 | 200,000 | 1/1', 4/4', 6/6', 7/7', 8/8', /11', 12, 13 |
| B | DADMAC/AA | 90/10 | 300,000 | 2/2' |
| C | DMAEM-MCQ/AcAm | 10/90 | 200,000 | 3/3' |
| D | EPI-DMA | 50/50 | 20,000 | 9/9' |
| E | EPI-DMA | 50/50 | 100,000 | 5/5' |
| F | DADMAC/AcAm | 25/75 | >1,000,000 | 9/9' |
| G | DADMAC | 100 | 130,000 | 10/10' |
| H | DADMAC | 100 | 300,000 | 10/10' |

In Table B above, and elsewhere herein, "AA" is used to designate the mer unit derived from acrylic acid and AcAm is used to designate the mer unit derived from acrylamide.

The cationic charge densities of the above polymers are as follows: Polymers D and E each have a cationic charge density of about 7.3 meq/gram; Polymers A, G and H each have a cationic charge density of about 6.2 meq/gram; Polymer B has a cationic charge density of about 5.3 meq/gram; Polymer F has a cationic charge density of about 2.7 meq/gram; and Polymer C has a cationic charge density of about 1.2 meq/gram;

EXAMPLE 1 AND COMPARATIVE EXAMPLE 1'

The pitch control performance of the combination of a cationic polymer and a lipase enzyme was determined using the test method described above, except that a pH 5, 0.5M sodium citrate buffer solution was used. The pulp slurry was the groundwood GW-1 slurry. The polymer was the A polymer, a DADMAC homopolymer. The filtrate turbidity values determined for each test sample in the series of Example 1 and Comparative Example 1' are set forth below in Table 1 together with the dosages of the additives.

TABLE 1

| Example or Comparative Example Designation | Dosage of Enzyme (kg/ton) | Dosage of Polymer (ppm) | Filtrate Turbidity Units (FTU) |
|---|---|---|---|
| blank | none | none | 175–178 |
| blank' | 0.5 | none | 153–155 |
| 1' | none | 10 | 156 |
| 1 | 0.5 | 10 | 140 |
| 1' | none | 20 | 139 |
| 1 | 0.5 | 20 | 130–131 |
| 1' | none | 30 | 127 |
| 1 | 0.5 | 30 | 112 |
| 1' | none | 40 | 117 |
| 1 | 0.5 | 40 | 88 |
| 1' | none | 50 | 89 |
| 1 | 0.5 | 50 | 65 |

In FIG. 1 there is shown a plot of test results (Filtrate Turbidity Units or "FTU") for both Example 1 and Comparative Example 1' versus polymer dosages. The rate at which performance increases as the polymer dosage increases is seen from the slopes of these plots. The polymer and enzyme combination together demonstrate a high level of increase in performance with increasing polymer charge (a steep slope) that continues without abatement at least through the highest dosage of polymer tested.

EXAMPLE 2 AND COMPARATIVE EXAMPLE 2'

Figure 2:
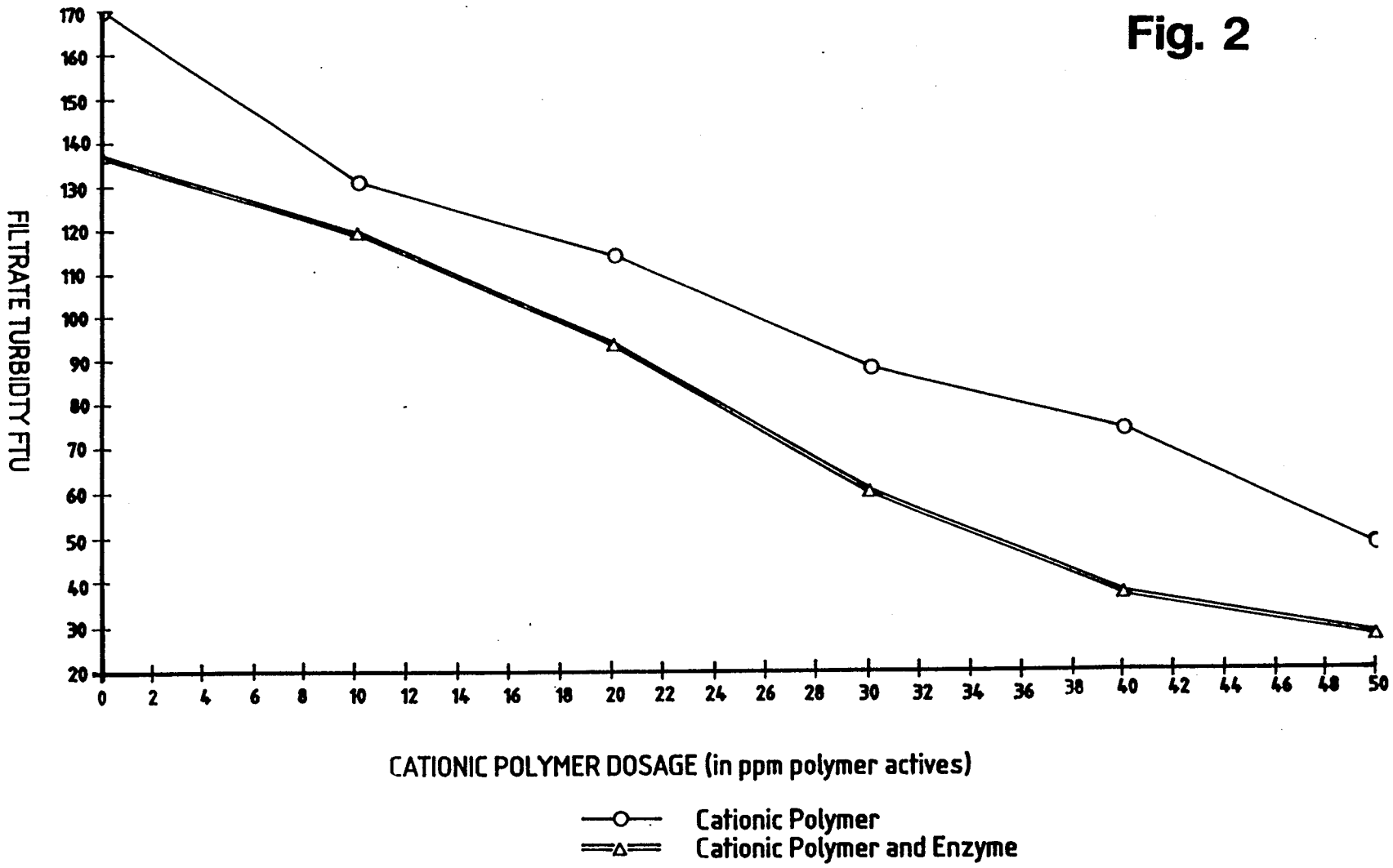
FIG. 2 is a plot of the pitch control performance, versus cationic polymer dosage, of a pitch control treatment of the present invention and a cationic polymer only treatment for comparison.

The pitch control performance of the combination of a cationic polymer and a lipase enzyme was determined using the test method described above, except that a pH 5, 0.5M sodium citrate buffer solution was used. The pulp slurry used was the groundwood slurry GW-1. The polymer was the B polymer, a DADMAC/acrylamide copolymer. The turbidity values measured for each test sample in the series of Example 2 and Comparative Example 2' are set forth below in Table 2 together with again the dosages of the additives. In FIG. 2 there is shown a plot of Filtrate Turbidity Values ("FTU") versus polymer dosages for Example 2 together with a plot for Comparative Example 2'.

TABLE 2

| Example or Comparative Example Designation | Dosage of Enzyme (kg/ton) | Dosage of Polymer (ppm) | Filtrate Turbidity Units (FTU) |
|---|---|---|---|
| blank | none | none | 170 |
| blank' | 0.5 | none | 137 |
| 2' | none | 10 | 131 |
| 2 | 0.5 | 10 | 119 |
| 2' | none | 20 | 114 |
| 2 | 0.5 | 20 | 93 |
| 2' | none | 30 | 88 |
| 2 | 0.5 | 30 | 60 |
| 2' | none | 40 | 74 |
| 2 | 0.5 | 40 | 37 |
| 2' | none | 50 | 48 |
| 2 | 0.5 | 50 | 28 |

EXAMPLE 3 AND COMPARATIVE EXAMPLE 3'

Figure 3:
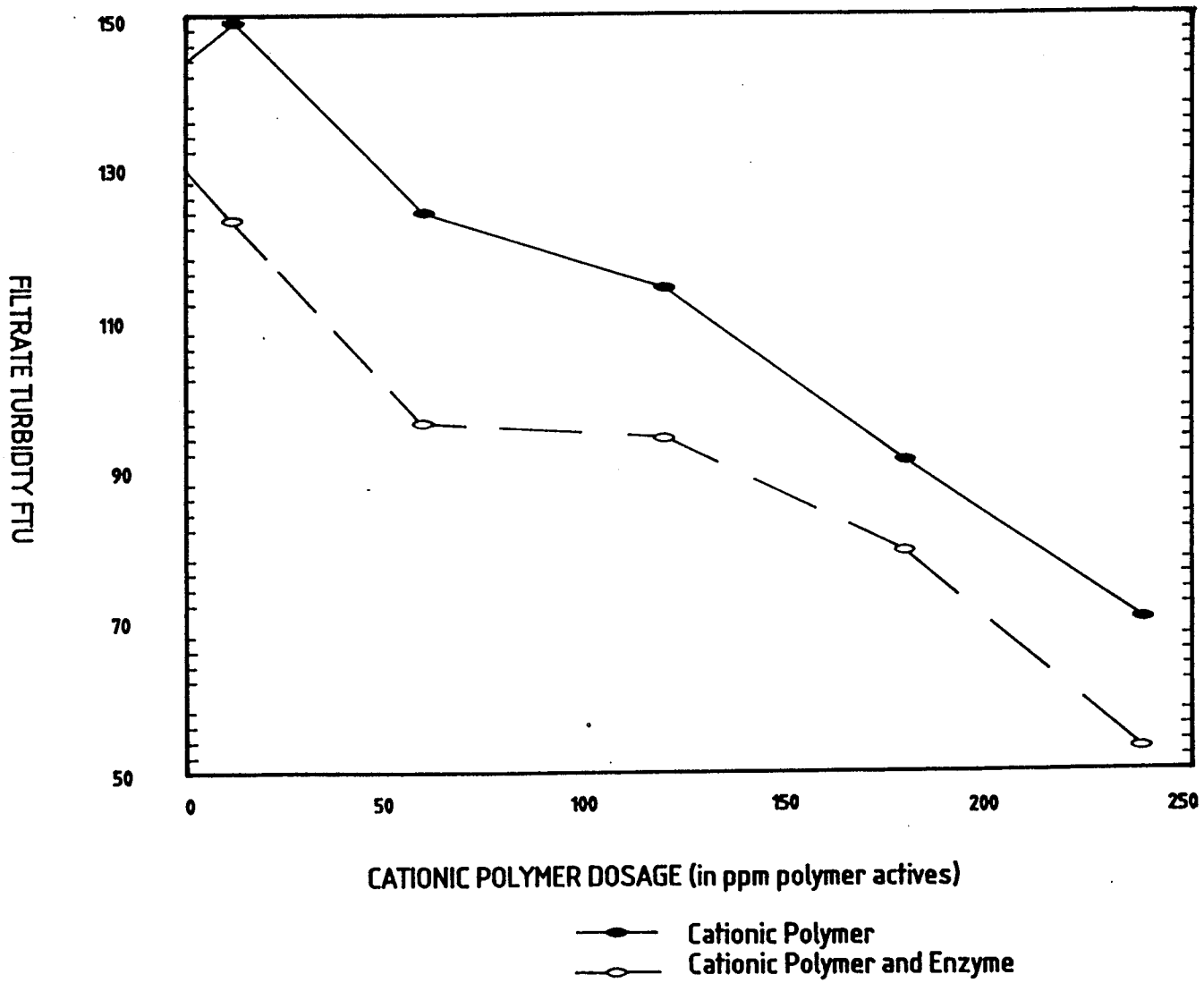
FIG. 3 is a plot of the pitch control performance, versus cationic polymer dosage, of a pitch control treatment of the present invention and a cationic polymer only treatment for comparison.

The pitch control performance of the combination of a cationic polymer and a lipase enzyme was determined using the test method described above, except that the polymer dosages varied from 12.5 to 250 ppm. (buffer pH 6.0) The pulp slurry used was the groundwood GW-2 slurry. The polymer was the C polymer, a DMAEM.MCQ/acrylamide copolymer. In FIG. 3 there is shown a plot of Filtrate Turbidity Values ("FTU") versus polymer dosages for Example 3 together with a plot for Comparative Example 3'.

EXAMPLE 4 AND COMPARATIVE EXAMPLE 4'

Figure 4:
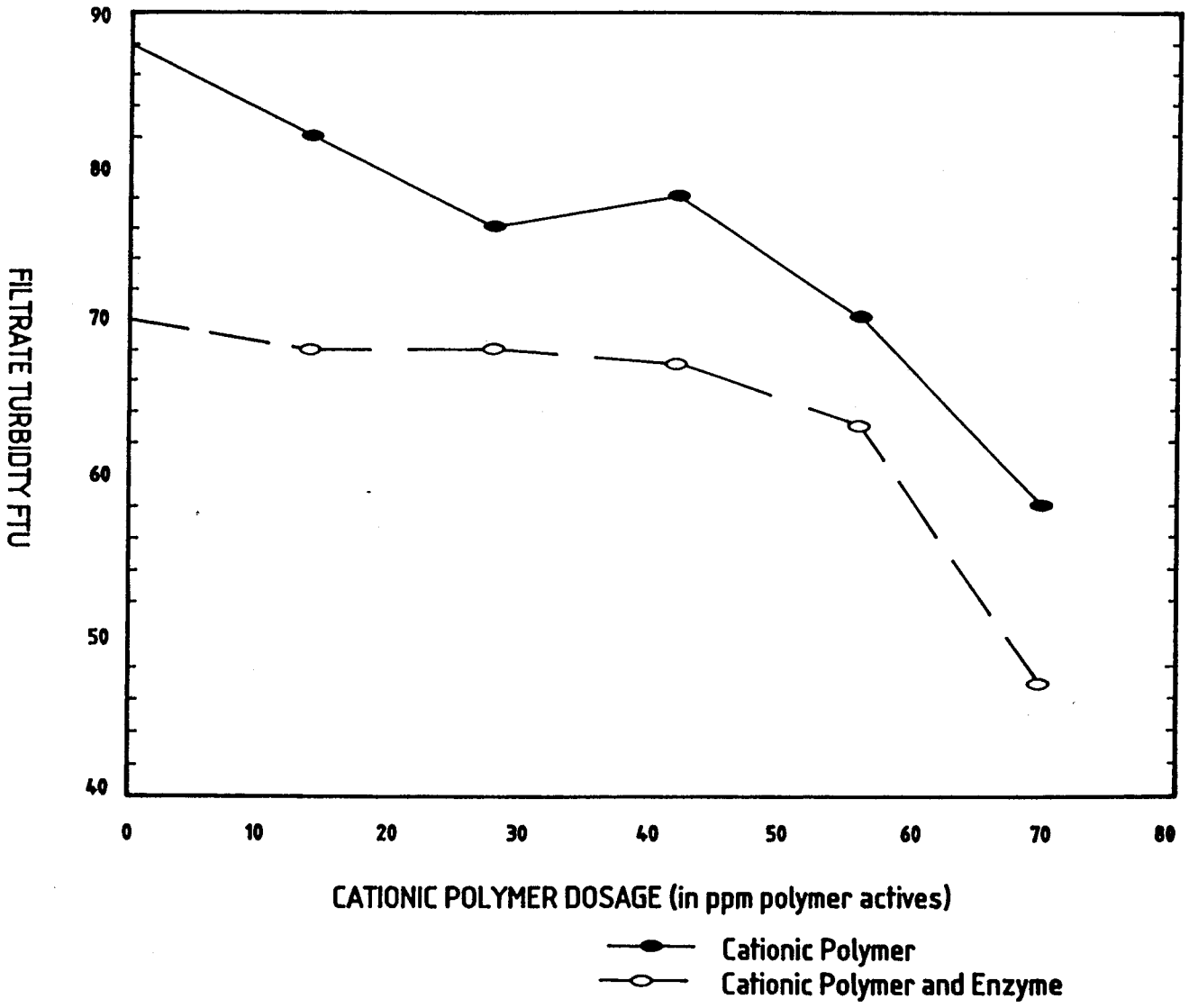
FIG. 4 is a plot of the pitch control performance, versus cationic polymer dosage, of a pitch control treatment of the present invention and a cationic polymer only treatment for comparison.

The pitch control performance of the combination of a cationic polymer and a lipase enzyme was determined using the test method described above, except that the pulp slurry used was the S-1 brown stock of sulfite pulp, which initially had a pH of about 3 that was adjusted to a pH of about 6 with 2N NaOH, and the polymer dosages tested ranged from 14 to 70 ppm. The polymer was the A polymer, a DADMAC homopolymer. In FIG. 4 there is shown a plot of Filtrate Turbidity Values ("FTU") versus polymer dosages for Example 4 together with a plot for Comparative Example 4'.

EXAMPLE 5 AND COMPARATIVE EXAMPLE 5'

Figure 5:
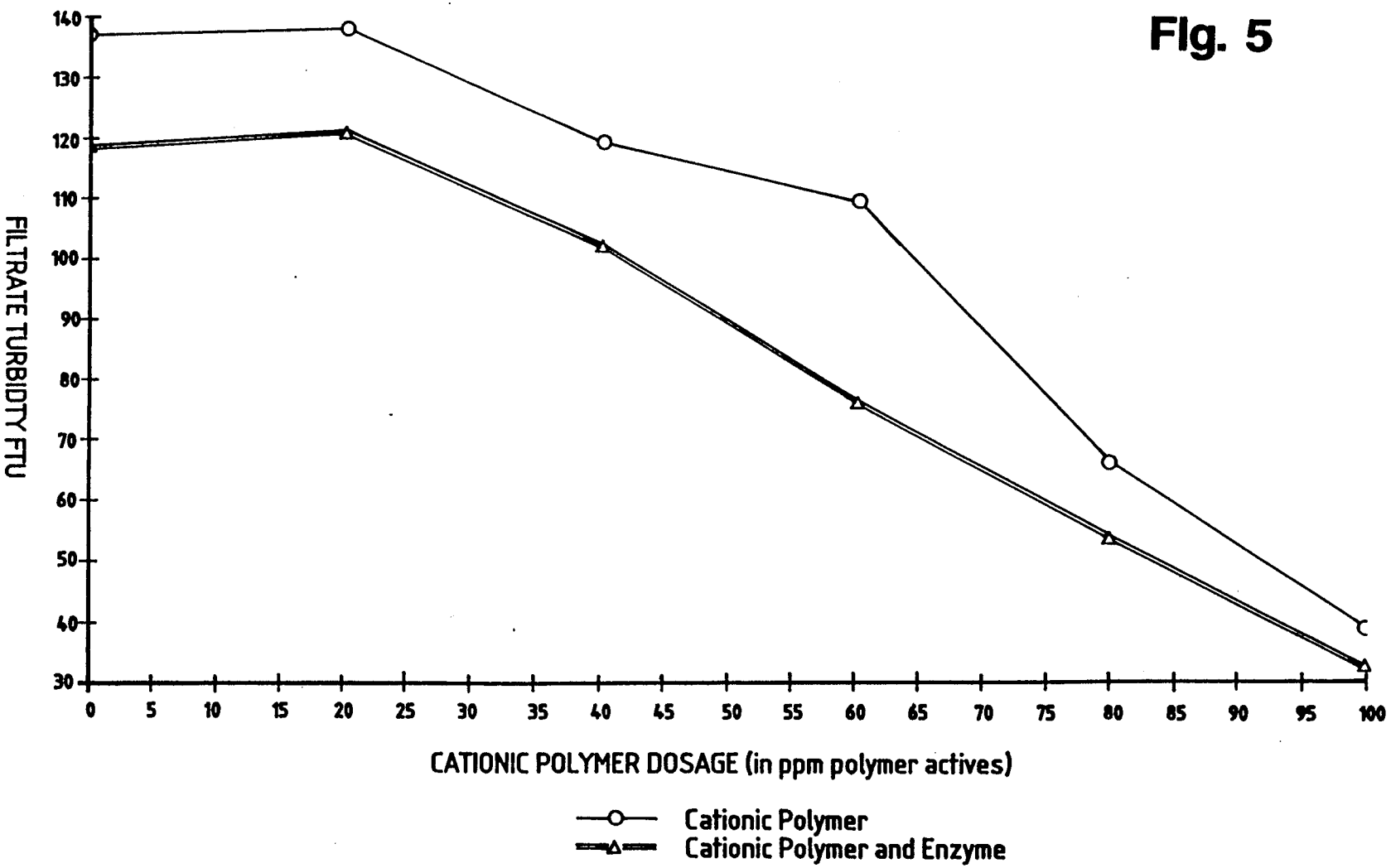
FIG. 5 is a plot of the pitch control performance, versus cationic polymer dosage, of a pitch control treatment of the present invention and a cationic polymer only treatment for comparison.

The pitch control performance of the combination of a cationic polymer and a lipase enzyme was determined using the test method described above, except the polymer dosages were from 20 ppm to 100 ppm and the pulp slurry consistency was 4.2 percent. The polymer was the E polymer, a cross-linked epichlorohydrin-dimethylamine polymer and the pulp slurry was the GW-2 slurry. In FIG. 5 there is shown a plot of Filtrate Turbidity Values ("FTU") versus polymer dosages for Example 5 together with the plot for Comparative Example 5'.

EXAMPLE 6

Figure 6:
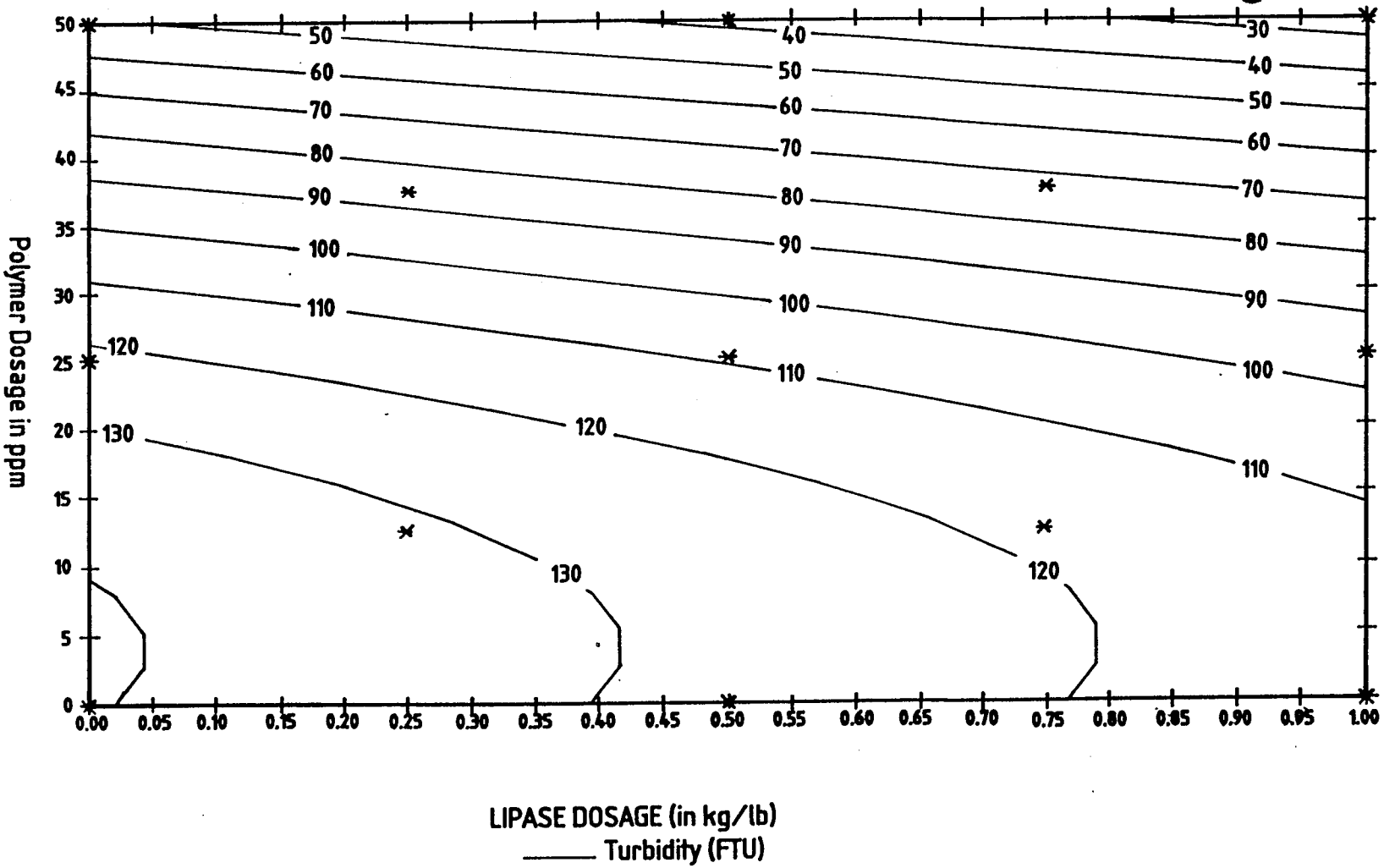
FIG. 6 is a contour plot of the pitch control performance, versus cationic polymer dosage and enzyme dosage, of the pitch control treatment of the present invention.

The pitch control performance of a cationic polymer/lipase enzyme combination was determined using the test method described above, in a 23-test experimental design wherein the dosages of both the polymer and enzyme were varied. The polymer employed was the A polymer, a DADMAC homopolymer. The pulp slurry used was the groundwood GW-2 pulp slurry. The turbidity values measured, together with the dosages of additives used, for each test sample in this series are set forth below in Table 3, wherein each test run, regardless of whether or not it was treated with both the polymer and enzyme, is assigned a "Test Designation Number". From the test results for each test aliquot, and its treatment parameters, a predicted equation was developed and used to generate a contour plot, which contour plot is shown in FIG. 6.

TABLE 3

| Test Designation Number | Dosage of Enzyme (kg/ton) | Dosage of Polymer (ppm) | Filtrate Turbidity Units |
|---|---|---|---|
| 1 | .0.00. | ..0.00. | 140.33.. |
| 2 | .1.00. | ..0.00. | 104.00.. |
| 3 | .0.50. | .50.00. | 31.50. |
| 4 | .0.50. | .25.00. | 121.50.. |
| 5 | .0.50. | .25.00. | 111.50.. |
| 6 | .0.00. | .25.00. | 134.50.. |
| 7 | .1.00. | .25.00. | 108.00.. |
| 8 | .0.50. | .25.00. | 155.50.. |
| 9 | .0.50. | .25.00. | 112.00.. |
| 10 | .0.00. | .50.00. | 56.50. |
| 11 | .0.50. | ..0.00. | 137.80.. |
| 12 | .1.00. | .50.00. | 31.00. |
| 13 | .0.50. | .25.00. | 94.00. |
| 14 | .0.00. | ..0.00. | 136.00.. |
| 15 | 0.25 | .12.50. | 127.67.. |
| 16 | 0.75 | .12.50. | 120.00.. |
| 17 | .0.00. | .25.00. | 122.00.. |
| 18 | .0.00. | .50.00. | 58.00. |
| 19 | 0.25 | .37.50. | 59.50. |
| 20 | .0.50. | .50.00. | 34.00. |
| 21 | 0.75 | .37.50. | 60.50. |

TABLE 3-continued

| Test Designation Number | Dosage of Enzyme (kg/ton) | Dosage of Polymer (ppm) | Filtrate Turbidity Units |
|---|---|---|---|
| 22 | .1.00. | .20.00. | 27.50. |
| 23 | .1.00. | .25.00. | 92.50. |

EXAMPLE 7 AND COMPARATIVE EXAMPLE 7'

Figure 7:
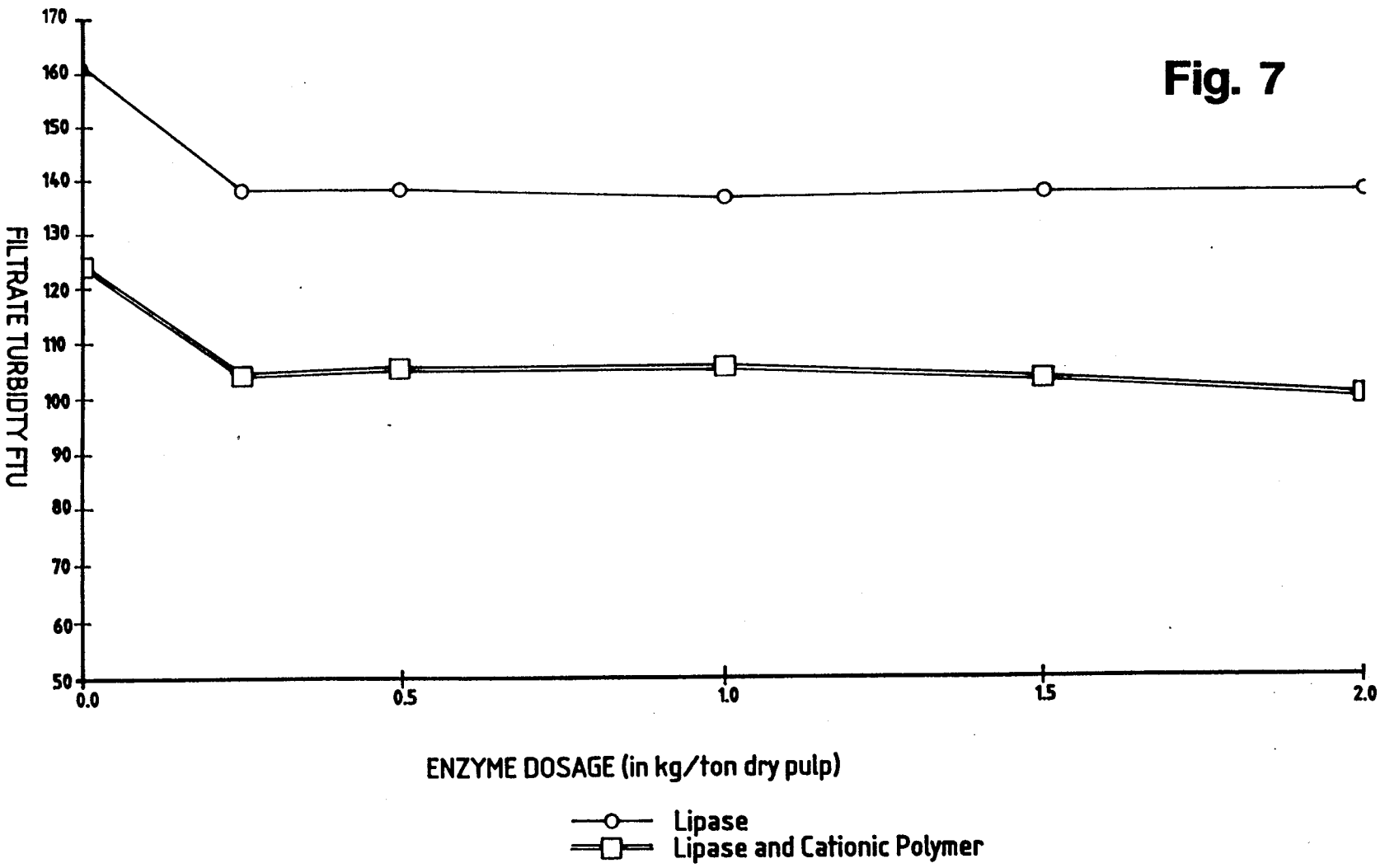
FIG. 7 is a plot of the pitch control performance, versus cationic polymer dosage, of a pitch control treatment of the present invention and a cationic polymer only treatment for comparison.

The pitch control performance of the combination of a cationic polymer and a lipase enzyme was determined using the test method described above, except that the test samples were treated either with no cationic polymer (Comparative Example 7') or with 20 ppm of cationic polymer, and varying dosages of the enzyme. For both this Example 7 and Example 7' the enzyme dosages varied from 0.25 kg/ton to 2.0 kg/ton (buffer pH 6.0). The pulp slurry used was the groundwood GW-1 slurry. The polymer was the A polymer, a DADMAC homopolymer. In FIG. 7 there is shown a plot of Filtrate Turbidity Values ("FTU") versus enzyme dosages for Example 7 together with a plot for Comparative Example 7'.

EXAMPLE 8 AND COMPARATIVE EXAMPLE 8'

Figure 8:
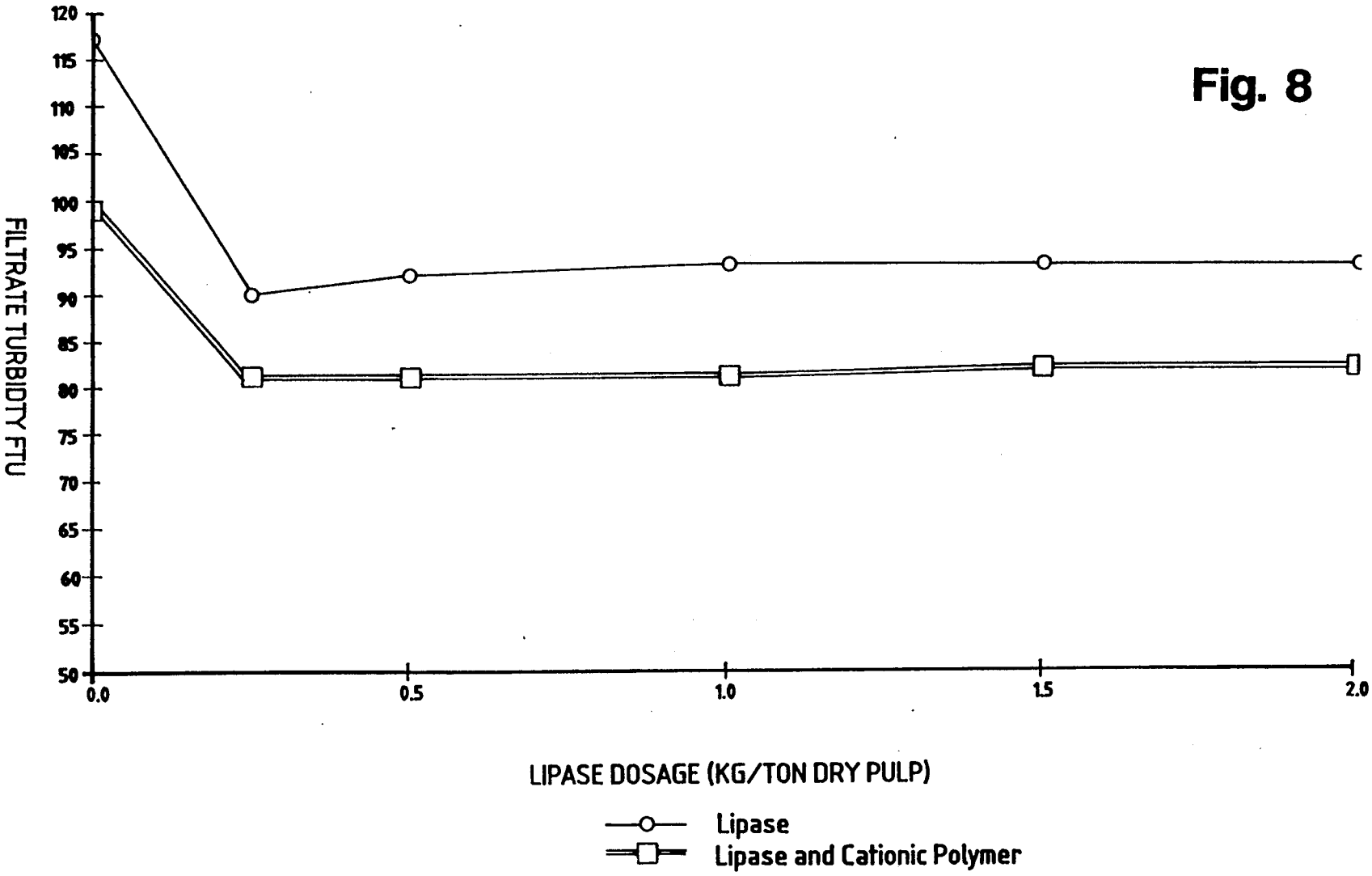
FIG. 8 is a plot of the pitch control performance, versus cationic polymer dosage, of a pitch control treatment of the present invention and a cationic polymer only treatment for comparison.

Example 7 and Comparative Example 7' were repeated except that the pulp slurry used was the groundwood GW-3 slurry. In FIG. 8 there is shown a plot of Filtrate Turbidity Values ("FTU") versus enzyme dosages for Example 8 together with a plot for Comparative Example 8'.

EXAMPLE 9 AND COMPARATIVE EXAMPLE 9'

Figure 9:
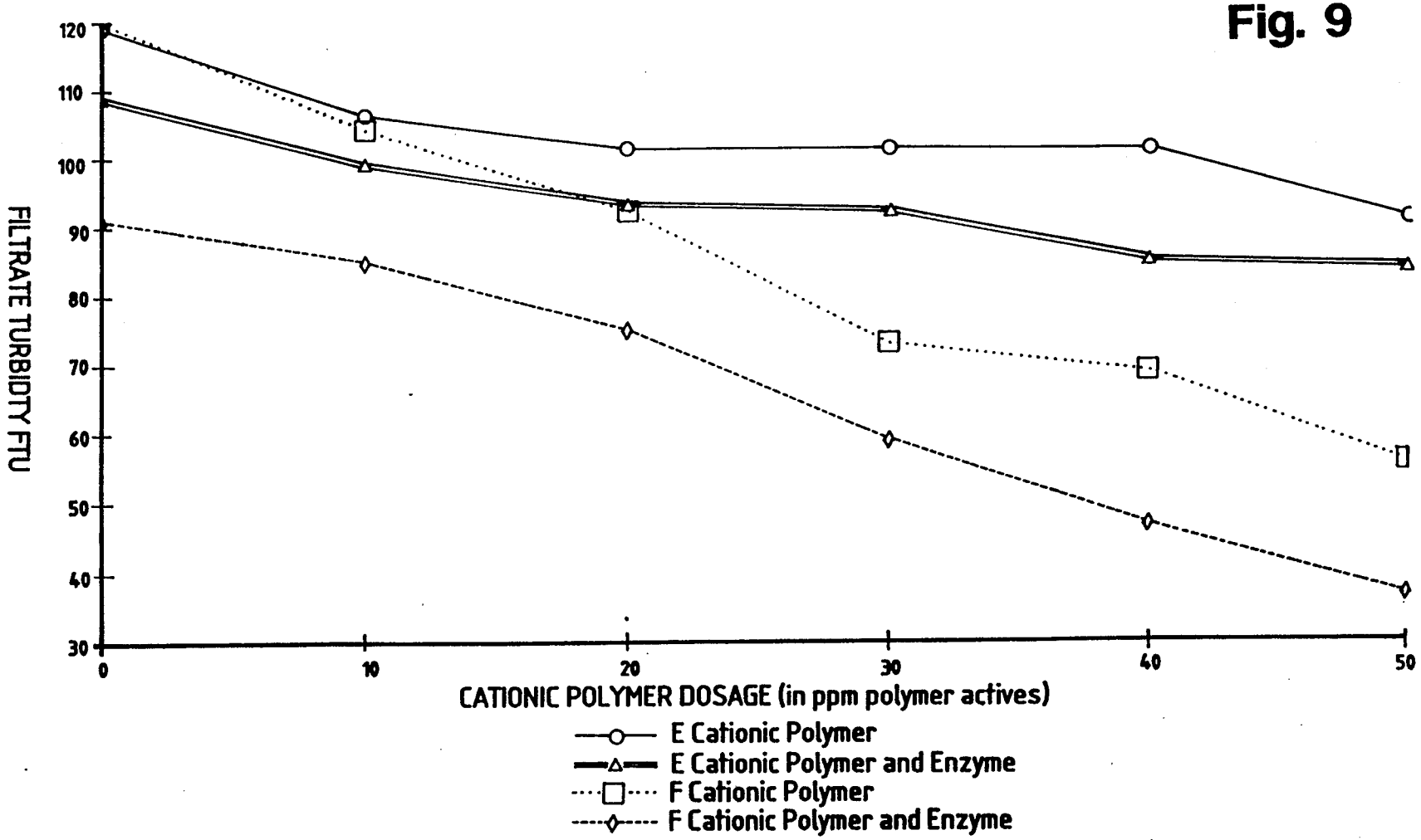
FIG. 9 is a plot of the pitch control performance, versus cationic polymer dosage, of two pitch control treatments of the present invention and two cationic polymer only treatments for comparison.

The pitch control performance of the combination of a cationic polymer and a lipase enzyme, for two different cationic polymers, was determined using the test method described above (buffer pH 6.0). The pulp slurry used was the groundwood GW-3 slurry. The polymers were the E polymer, a high charge density, low molecular weight EPI-DMA copolymer, and the F polymer, a low charge density, high molecular weight DMAC polymer. In FIG. 9 there are shown two plots of Filtrate Turbidity Values ("FTU") versus polymer dosages (one plot for each polymer used together with the enzyme) for Example 9 and two plots for the two polymers alone for Comparative Example 9'.

EXAMPLE 10 AND COMPARATIVE EXAMPLE 10'

Figure 10:
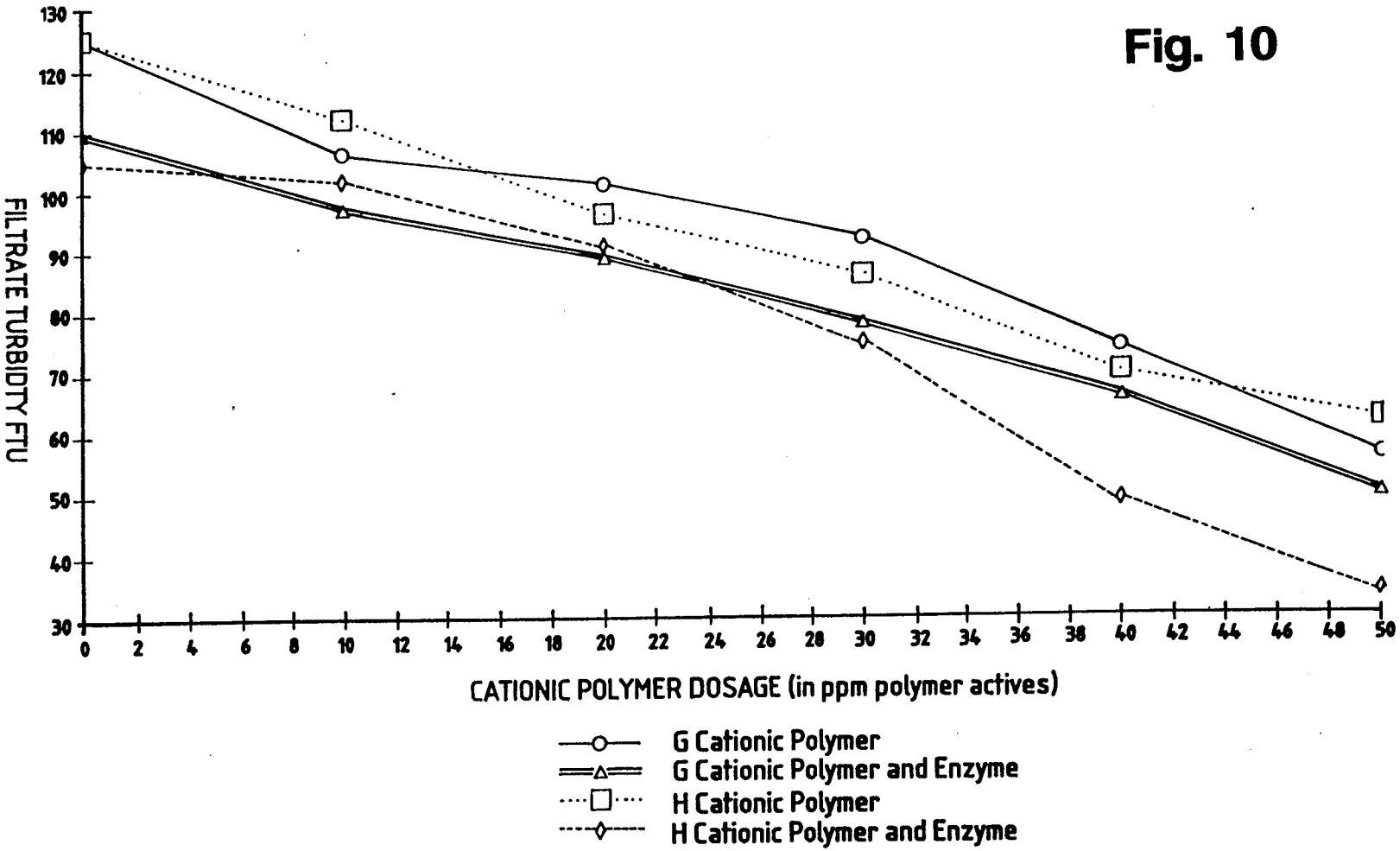
FIG. 10 is a plot of the pitch control performance, versus cationic polymer dosage, of two pitch control treatments of the present invention and two cationic polymer only treatments for comparison.

The pitch control performance of the combination of a cationic polymer and a lipase enzyme, for two different cationic polymers, was determined using the test method described above (buffer pH 6.0). The pulp slurry used was the groundwood GW-3 slurry. The polymers were the G polymer, a low molecular weight DADMAC homopolymer, and the H polymer, a high molecular weight DADMAC homopolymer. In FIG. 10 there are shown two plots of Filtrate Turbidity Values ("FTU") versus polymer dosages (one plot for each polymer used together with the enzyme) for Example 10 and two plots for the two polymers alone for Comparative Example 10'.

COMPARATIVE EXAMPLE 11'

Figure 11:
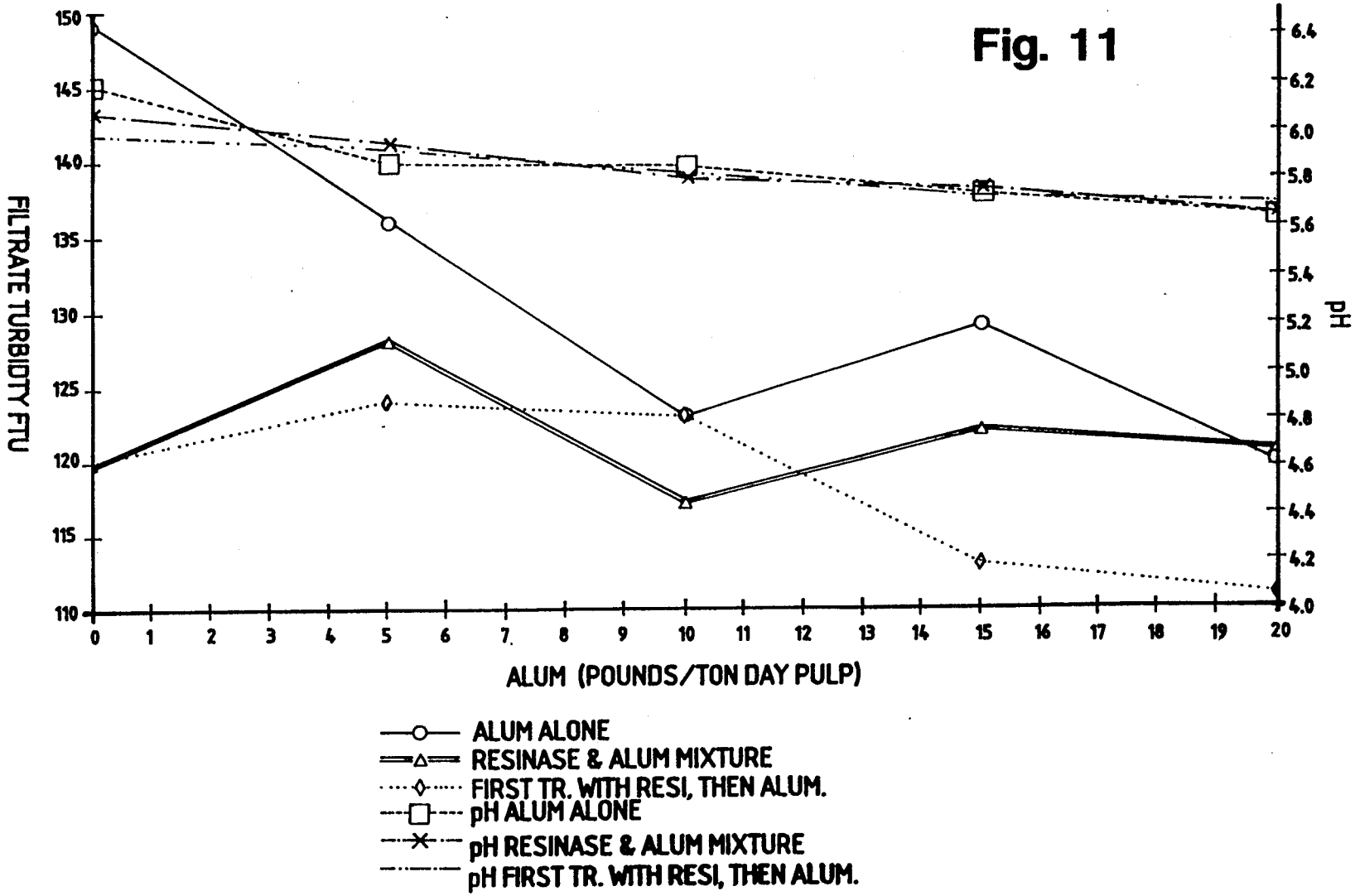
FIG. 11 is a plot of the pitch control performance, versus alum dosage, of a pitch control treatment using alum alone, and alum together with enzyme, by two addition methods, and the slurry pH, for a comparison to the present invention.

The effect of the presence of alum on the pitch control performance of a lipase enzyme, at various alum dosages, was determined using otherwise the test method described above. The pulp slurry used was the groundwood GW-2 slurry. The enzyme was employed at the 0.5 kg/ton dosage, and the dosage of the alum varied from 0 lb/ton to 20 lb/ton (pounds of dry alum, as aluminum sulfate octadecahydrate, per ton of dry pulp). Three test series were conducted using respectively alum alone, alum and enzyme added to the slurry together as a mixture, and alum and enzyme adding the enzyme first and then the alum. In FIG. 11 there are shown three plots of Filtrate Turbidity Values ("FTU") versus alum dosages (one plot for each of aforesaid series) for Comparative Example 11'. Also shown on FIG. 11 for each series are three plots the pH of the test samples (one plot for each of aforesaid series), again versus alum dosages.

EXAMPLE 12

The sample treatment portion of the test method described above was employed to provide treated pulp and filtrate specimens for each sample, which specimens were subjected to ether extraction and subsequent analyses of such extracts. Not only is pitch generally extractable from pulp with ether (diethyl ether), but pitch is also generally deemed the only pulp component that will be so extracted. The pulp slurry used was the groundwood GW-2 slurry. The polymer was the A polymer, a DADMAC polymer. Four test samples were run, which samples were treated with polymer alone (30 ppm dosage), with such dosage of polymer plus enzyme (0.5 kg/ton), such dosage of enzyme alone, and neither the polymer nor the enzyme (the control). The filtrations, after treatment and incubation, were vacuum filtrations through Reeve's Agnel 202 filters using a Buchner funnel. After the filtration for each run, the fiber and the filtrate for each were subjected to ether extraction, using anhydrous diethyl ether at pH 6. Each of the pulp fiber specimens were extracted with three 100 ml aliquots of ether, shaking the specimen in the ether aliquots at room temperature and removing the ether by the same filtration method as described above. The three ether aliquots were then combined, dried over sodium sulfate, filtered, and then evaporated to dryness. The filtrate specimens were similarly extracted with three equal portions of ether, the ether and aqueous phases were separated in a separation funnel, and the ether aliquots were combined, dried over sodium sulfate, filtered, and then evaporated to dryness. The residues of the extractions were weighed and then determined to be comprised of trilinolein and linoleic acid as the major components by GC/MS analysis. For each extract residue the total amounts of trilinolein and linoleic acid were determined respectively by GC and by GC/MS and HPLC. For each fiber and filtrate specimen, the total amount of the extracted residue, the amount of trilinolein and the amount linoleic acid determined is set forth below in Table 4, together with a summary of the treatment of the respective test sample.

TABLE 4

| Treatment | Total Extractables | Ether Extraction at pH 6 | | | |
|---|---|---|---|---|---|
| | | Trilinolein Content | | Linoleic Acid Content | |
| | | Filtrate | Fiber | Filtrate | Fiber |
| None | 280 | 29 | 68 | 2 | 4 |
| Polymer | 290 | 44 | 76 | 2 | 3 |
| Enzyme | 320 | 12 | 14 | 19 | 24 |
| Polymer and | 230 | 6 | 21 | 14 | 32 |

TABLE 4-continued

| Treatment | Total Extractables | Ether Extraction at pH 6 Trilinolein Content Filtrate | Trilinolein Content Fiber | Linoleic Acid Content Filtrate | Linoleic Acid Content Fiber |
|---|---|---|---|---|---|
| Enzyme | | | | | |

EXAMPLE 13

Example 12 was repeated except that extractions with diethyl ether were conducted at pH 3, and the preextraction treatments were limited to the polymer alone and the polymer together with enzyme. For each fiber and filtrate specimen, the total amount of the extracted residue, the amount of trilinolein and the amount linoleic acid determined is set forth below in Table 5, together with a summary of the treatment of the respective test sample.

TABLE 5

| Treatment | Total Extractables | Ether Extraction at pH 3 Trilinolein Content Filtrate | Trilinolein Content Fiber | Linoleic Acid Content Filtrate | Linoleic Acid Content Fiber |
|---|---|---|---|---|---|
| Polymer | 170 | 49 | 97 | 3 | 6 |
| Polymer and Enzyme | 190 | 12 | 31 | 11 | 24 |

EXAMPLE 14

Figure 12:
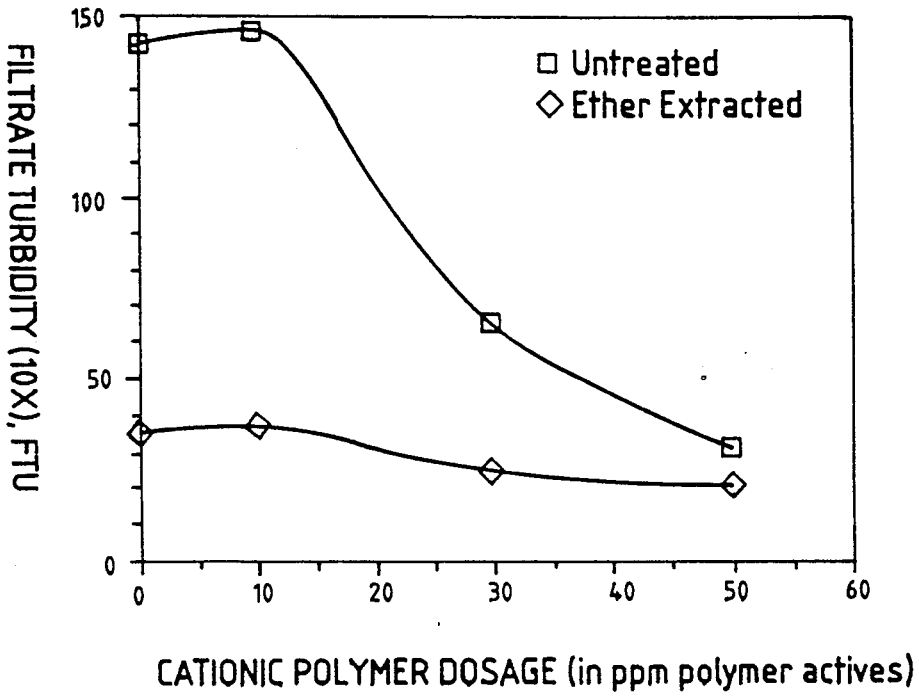
FIG. 12 is a plot of the filtrate turbidity, versus cationic polymer dosage, of cationic polymer only treatments of ether extracted and nonextracted pulps.

The pitch control performance of a cationic polymer alone was determined using the test method described above on a normal ("unextracted") pulp sample versus an extracted pulp sample to demonstrate that the test method's Filtrate Turbidity Value results reflect pitch control performance. The extracted pulp had been subjected to ether extraction to remove all pitch components. (buffer pH 5) The pulp slurry used for both series of tests was the groundwood GW-1 slurry. The polymer used for both series of tests was the A polymer, a DADMAC homopolymer. The filtration was conducted through Reeves Angel 202 filters until 25 ml. of filtrate had been collected for each test sample. For each test series, the polymer dosages tested were 10, 30 and 50 ppm of polymer actives. No enzyme was included in any of the test samples. In FIG. 12 there are shown two plots of Filtrate Turbidity Values ("FTU") versus polymer dosages (one plot for the extracted pulp and one plot for the unextracted pulp) for this Example 14. As seen from the plots of FIG. 12, the ether extraction treatment alone drastically reduces the FTU value, and such extracted pulp has only a slight response, as to FTU value, to treatment with the cationic polymer, in comparison to the significant response of the unextracted pulp. Further, as the amount of the cationic polymer increases in the treatment of the unextracted pulp, the FTU values ensuing approach the low values seen for the extracted pulp, both alone and with cationic polymer treatment. The comparison of these two plots demonstrates that the FTU values follow the pitch component content of the pulp, and further that the FTU values achieved by pitch control treatment of unextracted pulp with the DADMAC homopolymer are higher than, but approach, the "zero line" pitch content of the extracted pulp plot. The pulp slurry and the DADMAC homopolymer used in this Example 14 are the same as that used in Example 1 above, and thus a comparison between the pitch control effectiveness of this cationic polymer on this pulp slurry and the combination of cationic polymer and enzyme is provided in Example 1.

In all of the Examples above, the dosage of the enzyme is given in terms of the weight of the Resinase A 2X product, which has an activity of 100 KLU/gram, as described above.

It has been found that a lower FTU value is achieved for a given dosage of cationic polymer and enzyme when the pulp slurry consistency is relatively high during pitch control treatment. For instance, using a 30 ppm dosage of Polymer A and 0.25 kg/ton dry pulp solids dosage of Resinase A 2X, the FTU values achieved when the pulp slurry (a groundwood Aspen pulp slurry) was concentrated with a rotary evaporator to 4.2 and 4.95% were lower than that achieved at a 3.2% consistency. Moreover, the FTU value achieved using the 4.95% consistency slurry was lower than that achieved using the 4.2% consistency slurry. Another preferred embodiment of the invention is a method wherein the cellulosic slurry has a consistency of from about 3.5 to about 8, and more preferably from about 3.5 to about 6.0, or 6.5%. The preference for a higher consistency pulp slurry at the time of pitch control treatment may at times dictate at least in part the preferred point of treatment in a paper mill.

It has also been found that there are no significant differences in the pulp extraction efficiencies of diethyl ether and methylene chloride, both solvents extracting about the same amounts of triglycerides, of which trilinolein was the major triglyceride, comprising about 45 wt. percent of the extracted material. Using a pulp sample extraction method on both untreated and treated groundwood Aspen pulp samples, it was determined that a Resinase A 2X dosage of 0.25 kg/ton of dry pulp reduced the trilinolein content of the pulp by 74 wt. percent, and the level of trilinolein reduction was raised to 88 wt. percent when the enzyme dosage was increased to 2 kg/ton of dry pulp. Moreover, at the higher levels of trilinolein reduction, the amounts of linoleic acid in the pulp samples were close to the theoretical amounts of linoleic acid generated by complete hydrolysis of trilinolein to linoleic acid. At lower levels of trilinolein reduction, the amounts of linoleic acid in the pulp samples were less than theoretical, and thus mono- and/or di-linolein were presumably also formed. Given the pitch control results demonstrated in the Examples above, it is clear that the present pitch control method does not require lipase dosages in the amount required for complete hydrolysis of triglycerides to the corresponding fatty acids.

It was also found that when a groundwood Aspen pulp at 3.2% consistency was treated with 50 ppm of Polymer A and 2 kg/ton dry pulp of Resinase A 2X, with a buffer pH of 6.0, an agitation rate of 250 rpm, temperature of 45° C., and an incubation time of 2 hours, a complete hydrolysis of trilinolein to linoleic acid occured, and a majority of such linoleic acid was found associated with the pulp fiber fraction when the fiber fraction was separated by vacuum filtration through a Reeve's Angle 202 filter using a Buchner funnel. When samples of such separated fiber were resuspended in water and agitated for two hours at 484 and 950 rpm respectively, the linoleic acid associated with the fiber was not released to the aqueous medium, demonstrating a strong binding that not disrupted by agitation levels that may be encountered in a paper mill.

By the general term "paper" is meant herein all types of paper products produced from a cellulosic slurry from pulped wood, including without limitation thin sheets of paper used for documents, books, newspapers, magazines and the like and heavier grades of paper used for packaging, corrugated paper, shipping containers and the like. By the general term "wood" is meant herein all types of wood, regardless of whether categorized as softwood or hardwood. By the general term "cellulosic slurry" is meant herein an aqueous slurry containing cellulose derived from a wood pulping process, regardless of whether such cellulose is derived from hardwood or softwood or combinations thereof, and regardless of whether the pulping process(es) employed to provide such slurry is categorized as a mechanical or chemical or secondary fiber or hybrid pulping process, or whether the slurry is derived from a plurality of types of pulping processes, and regardless of whether or not the pulp, or part of the pulp, has been bleached. By the term "lipase" is meant herein a hydrolytic enzyme that hydrolyzes ester bonds of neutral lipids, regardless of whether obtained by extraction from animal or vegetable tissue and the like, or produced by fermentation of selected microorganisms.

The present invention provides a method of controlling pitch deposits in a pulp and papermaking process comprising adding lipase and a cationic polymer to a cellulosic slurry in amounts effective for diminishing pitch deposits from the cellulosic slurry in a pulp and/or paper mill. The present invention also provides a method of controlling pitch deposits in a pulp and papermaking process employing a cellulosic slurry that contains triglyceride comprising adding lipase and a cationic polymer to a cellulosic slurry in amounts effective for both reducing the triglyceride content of a cellulosic slurry by hydrolysis and diminishing the concentration of fatty acids released by the hydrolysis in the aqueous phase of a cellulosic slurry, whereby an enhanced control of pitch deposits is achieved. The present invention also provides a method of reducing the triglyceride content of the aqueous phase of a cellulosic slurry wherein triglyceride hydrolysate is formed by the action of lipase on triglyceride within the cellulosic slurry, comprising maintaining in the cellulosic slurry an amount of lipase and an amount of a cationic polymer for a time period sufficient to hydrolyze at least some of the triglyceride in the cellulosic slurry and release at least some triglyceride hydrolysate (one or more products of the at least partial hydrolysis of triglyceride) to the aqueous phase of the cellulosic slurry, wherein the amount of the cationic polymer is sufficient to reduce the triglyceride hydrolysate in the aqueous phase of the cellulosic slurry.

In these methods the cellulosic slurry preferably is at an elevated temperature at the time the lipase and the cationic polymer are added thereto, and then is held at an elevated temperature during an incubation period. Preferably the elevated temperature of the cellulosic slurry is from about 35° C. to about 55° C. at the time of the addition of the lipase and the cationic polymer, and the incubation period is a time period of from about 1.5 to about 4 hours after the lipase and the cationic polymer have been added to the cellulosic slurry. The pH of the cellulosic slurry is preferably within the range of from about 4 to about 7 at least during a sufficient portion of the incubation period to effectuate a degree of triglyceride hydrolysis, and more preferably the pH is from about 4.5 to about 6.5.

In such methods the cationic polymer is preferably added to the cellulosic slurry as an aqueous solution of polymer actives, containing from about 0.05 to about 0.5 weight percent of the cationic polymer actives, and the lipase is added to the cellulosic slurry as an aqueous solution of a lipase preparation, the aqueous solution containing from about 0.02 to about 0.2 weight percent of a 100 KLU/gram lipase preparation.

In such methods the lipase is preferably added to the cellulosic slurry in the amount of from about 110 to about 12,20 parts per million, based on the weight of a 100 KLU/gram lipase preparation in comparison to the dry weight of solids in the cellulosic slurry and the cationic polymer is added to the cellulosic slurry in the amount of from about 10 to about 100 parts per million based on the weight of cationic polymer actives in comparison to the dry weight of solids in the cellulosic slurry.

In certain preferred embodiments, the cellulosic slurry is a mechanical pulp, a thermo-mechanical pulp or a mixture thereof.

In preferred embodiments, the cationic polymer is a polydiallyldimethyl ammonium chloride, acrylic acid/diallyldimethyl ammonium chloride copolymer, dimethylaminoethylmethacrylate methyl chloride ammonium salt/acrylamide copolymer, epichlorohydrin/dimethylamine polymer, or a mixture thereof. The weight average molecular weight of the cationic polymer is preferably from about 5,000 to about 5,000,000 daltons. In more preferred embodiments, the cationic polymer is a diallyldimethyl ammonium chloride homopolymer or a diallyldimethyl ammonium chloride/acrylamide copolymer. In further preferred embodiments the cationic polymer has a weight average molecular weight of from about 20,000 to about 3,000,000 daltons and has a cationic charge density of from about 2 to about 8. In certain preferred embodiments the cationic polymer cationic polymer has a weight molecular weight of from about 500,000 to about 3,000,000, and a cationic charge density of from about 6 to about 8. In other preferred embodiments the cationic polymer has a weight average molecular weight of from about 5,000 to about 1,000,000 daltons, and a cationic charge density of from about 1 to about 6.

In preferred embodiment, the lipase is at least initially maintained in the cellulosic slurry in the amount of from about 200 to about 1,000 parts per million, based on the weight of a 100 KLU/gram lipase preparation in comparison to the dry weight of solids in the cellulosic slurry and the cationic polymer is at least initially maintained in the cellulosic slurry in the amount of from about 30 to about 70 parts per million based on the weight of cationic polymer actives in comparison to the dry weight of solids in the cellulosic slurry.

INDUSTRIAL APPLICABILITY OF THE INVENTION

The present invention is applicable to the pulp and paper industries, and the industries that employ high quality paper products.

We claim:

1. A method of controlling pitch deposits in a pulp and papermaking process comprising:

adding lipase and a cationic polymer to a triglyceride-containing papermaking cellulosic slurry, said cellulosic slurry having an aqueous phase, wherein said lipase is added in an amount effective to reduce the content of said triglyceride in said cellulosic slurry by hydrolysis of said triglyceride to glycerol and fatty acids, wherein said triglyceride content reduction diminishes pitch deposits from said cellulosic slurry in a pulp and/or paper mill, and said cationic polymer is added in an amount effective to enhance said diminishing of pitch deposits activity of said lipase at least in part by diminishing the concentration of said fatty acids in said aqueous phase of said cellulosic slurry.

2. The method of claim 1 wherein said cellulosic slurry is at an elevated temperature at the time said lipase and said cationic polymer are added thereto, and then is held at an elevated temperature during an incubation period.

3. The method of claim 2 wherein said elevated temperature of said cellulosic slurry is from about 35° C. to about 55° C. at the time of the addition of said lipase and said cationic polymer, and said incubation period is a time period of from about 1.5 to about 4 hours after said lipase and said cationic polymer have been added to said cellulosic slurry.

4. The method of claim 1 wherein said cellulosic slurry has a pH within a range of about 4 to about 7 during said incubation period to effectuate a degree of triglyceride hydrolysis.

5. The method of claim 4 wherein said pH is from about 4.5 to about 6.5.

6. The method of claim 1 wherein said cationic polymer is added to said cellulosic slurry as an aqueous solution of polymer actives, containing from about 0.05 to about 0.5 weight percent of said cationic polymer actives and wherein said cationic polymer is added to said cellulosic slurry in the amount of from about 10 to about 100 parts per million based on the weight of cationic polymer actives in comparison to the dry weight of solids in said cellulosic slurry.

7. The method of claim 1 wherein said lipase is added to the cellulosic slurry as an aqueous solution of a 100 KLU/gram lipase preparation, containing from about 0.02 to about 0.2 weight percent of said a 100 KLU/gram lipase preparation.

8. The method of claim 1 wherein said lipase is added to said cellulosic slurry in the amount of from about 50 to about 1,500 parts per million, based on the weight of a 100 KLU/gram lipase preparation in comparison to the dry weight of solids in said cellulosic slurry.

9. The method of claim 1 wherein said cationic polymer is added to said cellulosic slurry in the amount of from about 10 to about 80 parts per million based on the weight of cationic polymer in comparison to the dry weight of solids in said cellulosic slurry.

10. The method of claim 1 wherein said cellulosic slurry is a mechanical pulp, a thermo-mechanical pulp or a mixture thereof.

11. The method of claim 1 wherein said cationic polymer is a polydiallyldimethyl ammonium chloride, acrylic acid/diallyldimethyl ammonium chloride copolymer, dimethylaminoethylmethacrylate methyl chloride ammonium salt/acrylamide copolymer, epichlorohydrin/dimethylamine polymer, or a mixture thereof.

12. The method of claim 1 wherein the weight average molecular weight of said cationic polymer is from about 5,000 to about 5,000,000 daltons.

13. A method of controlling pitch deposits in a pulp and papermaking process employing a cellulosic slurry that contains triglyceride comprising:

adding lipase and a cationic polymer to said cellulosic slurry in amounts effective for both reducing said triglyceride content of said cellulosic slurry by hydrolysis and diminishing the concentration of fatty acids released by said hydrolysis in the aqueous phase of said cellulosic slurry, whereby an enhanced control of pitch deposits is achieved, wherein said cationic polymer is added to said cellulosic slurry in the amount of from about 10 to about 80 parts per million based on the weight of cationic polymer actives in comparison to the dry weight of solids in said cellulosic slurry.

14. The method of claim 13 wherein said cationic polymer is a diallyldimethyl ammonium chloride homopolymer or a diallyldimethyl ammonium chloride/acrylamide copolymer having a weight average molecular weight of from about 5,000 to about 5,000,000 daltons.

15. The method of claim 13 wherein said cationic polymer has a weight average molecular weight of from about 20,000 to about 3,000,000 daltons and has a cationic charge density of from about 2 to about 8 meq/gram.

16. The method of claim 13 wherein said cationic polymer cationic polymer has a weight molecular weight of from about 500,000 to about 3,000,000, and a cationic charge density of from about 6 to about 8 meq/gram.

17. The method of claim 13 wherein said cationic polymer has a weight average molecular weight of from about 5,000 to about 1,000,000 daltons, and a cationic charge density of from about 1 to about 6 meq/gram.

18. A method of reducing the triglyceride content of the aqueous phase of a cellulosic slurry wherein triglyceride hydrolysate is formed by the action of lipase on triglyceride within said cellulosic slurry, comprising:

maintaining in said cellulosic slurry an amount of lipase and an amount of a cationic polymer for a time period sufficient to hydrolyze at least some of said triglyceride in said cellulosic slurry and release at least some triglyceride hydrolysate to said aqueous phase of said cellulosic slurry, wherein said lipase is at least initially maintained in said cellulosic slurry in the amount of from about 200 to about 1,000 parts per million, based on the weight of a 100 KLU/gram lipase preparation in comparison to the dry weight of solids in said cellulosic slurry and said cationic polymer is sufficient to reduce the triglyceride hydrolysate in said aqueous phase of said cellulosic slurry and is at least initially maintained in said cellulosic slurry in the amount of from about 30 to about 70 parts per million based on the weight of cationic polymer actives in comparison to the dry weight of solids in said cellulosic slurry.

19. The method of claim 18 wherein said cationic polymer is a polyDADMAC, acrylic acid/diallyldimethyl ammonium chloride copolymer, dimethylaminoethylmethacrylate methyl chloride quaternary ammonium salt/acrylamide copolymer, epichlorohydrin/dimethylamine polymer, or a mixture thereof having a weight average molecular weight of from about 5,000 to about 5,000,000 daltons and having a cationic charge density of from about 1 to about 8 meq/gram.

20. The method of claim 19 wherein said cationic polymer cationic polymer has a weight molecular weight of from about 500,000 to about 3,000,000 and a cationic charge density of from about 6 to about 8 meq/gram, or has a weight average molecular weight of from about 5,000 to about 1,000,000 daltons and a cationic charge density of from about 1 to about 6 meq/gram.

* * * * *